United States Patent [19]

Glaze, Jr.

[11] 4,132,156

[45] Jan. 2, 1979

[54] ROTARY TRAY FORMER

[75] Inventor: John W. Glaze, Jr., Charlotte, N.C.

[73] Assignee: Intech Corporation, Charlotte, N.C.

[21] Appl. No.: 808,680

[22] Filed: Jun. 21, 1977

[51] Int. Cl.[2] ..... B31B 1/02

[52] U.S. Cl. ..... 93/51.1

[58] Field of Search ..... 93/44, 51.1, 51 HW

[56] References Cited

U.S. PATENT DOCUMENTS

| | | | |
|---|---|---|---|
| 1,864,632 | 6/1932 | Bergstein | 93/44.1 R |
| 2,821,054 | 1/1958 | Ritscher | 93/44.1 R X |
| 2,931,276 | 4/1960 | Zerlin | 93/44.1 R X |
| 3,469,508 | 9/1969 | Klapp | 93/44.1 R |
| 3,683,755 | 8/1972 | Lattke | 93/44.1 R X |
| 4,012,999 | 3/1977 | Crawford | 93/51.1 |

*Primary Examiner*—Howard N. Goldberg
*Assistant Examiner*—Paul A. Bell
*Attorney, Agent, or Firm*—Schuyler, Birch, Swindler, McKie & Beckett

[57] ABSTRACT

A rotary receptacle forming apparatus is disclosed which automatically forms a receptacle from a precut and prescored flat receptacle blank. Individual ones of the receptacle blanks are fed by a feeding mechanism from a stack of receptacle blanks to a die. According to the present invention, the rotating mandrel and the die cooperate with each other to achieve linear motion. This is accomplished by constantly maintaining the rotating mandrel in a fixed orientation parallel to the die while the mandrel passes through the die and, at the same time, enabling the die to track the mandrel by moving radially of the circular path of the mandrel. After the mandrel moves through the die, movable forming means on the mandrel fold the corner hinges on the receptacle blank. The driving force for the movable forming means is derived from the movement which enables the mandrel to maintain a fixed orientation relative to the die. The completed receptacle is removed from the mandrel by stripping fingers positioned adjacent the circular path of the mandrel. Because the mandrel is maintained in the same fixed orientation during removal of the receptacle, these stripping fingers can be positioned to remove the receptacle without interfering with the movement of the mandrel in the circular path.

35 Claims, 36 Drawing Figures

24
24
28
28
27
27
40
48
318
400
402
404
406
408
410
412
414
416
418
420
422
428
434
436
438
440
444
446
448
450
456
458
464
468
480
482
484
502
504
516
305
307
320
322

26
26
25
25
12
12
40
48
400
402
404
406
408
412
414
416
418
420
422
424
426
428
430
432
434
436
438
440
444
446
458
460
462
464
466
468
470
472
474
476
478
480
482
484
504

ROTARY TRAY FORMER

BACKGROUND OF THE INVENTION

The present invention is directed to apparatus for forming a receptacle from a precut and prescored flat receptacle blank by the interaction of a mandrel moving in a circular path and a die.

Receptacle forming machines in which a rotating mandrel engages a flat receptacle blank for the purpose of forming a receptacle are old in the art. One of the earliest of such machines is disclosed in U.S. Pat. No. 1,864,632 issued to Bergstein on June 28, 1932. In the Bergstein tray former, a tray blank is positioned on a die by a feeding mechanism. An adhesive is applied to the tray blank and the side walls are folded as the tray blank travels along the feeding mechanism. A rotating mandrel engages the tray blank on the die and passes through both the die and a series of pressure rollers in an arcuate path to form the tray. While the mandrel passes through the pressure rollers, a spring biased plunger for engaging the flaps is actuated by frictional forces between the plunger and the pressure rollers; the plunger engages the flaps of the tray blank and holds the tray. The completed tray is removed from the mandrel by a brush after the plunger disengages the flaps of the tray.

The disadvantages of the Bergstein tray former are typical of the disadvantages of other rotary tray formers in the prior art. In all these tray formers, the mandrel passes through the forming station such as the die and pressure rollers in Bergstein in an arcuate path. As a result, it is very difficult to match the forming operation on the inside radius with the outside radius. For this reason, tray formers such as reciprocating tray formers with a straight line relationship between the mandrel and the forming station are generally preferred. Another disadvantage of prior rotary tray formers concerns the removal of the completed tray from the rotary mandrel without interfering with the path of movement of the mandrel. Prior tray removal techniques often have been cumbersome, unreliable and inefficient. For example, in the Bergstein patent, the tray is removed from the mandrel by rotating brushes which cause the tray to fall through the circular path of the rotating mandrel. Thus, the angular velocity of the mandrel must be limited in order to prevent the mandrel from interfering with the free fall of the tray. Yet another disadvantage of prior rotary tray formers is the limited capability of the mandrel to perform active tray forming functions. Prior art attempts to provide movable elements on a rotating mandrel have been either very limited as in the Bergstein patent or extremely complicated and expensive to manufacture as in the cam operated mandrels described below. Finally, another disadvantage of the prior art rotary tray formers has been the lack of the additional capability of folding and gluing a portion of the tray blank before the rotating mandrel engages the tray blank.

Several recent patents are similar in many respects to the rotary tray former disclosed in the Bergstein patent. For example, U.S. Pat. No. 3,469,508 issued to Klapp on Sept. 30, 1969 shows a rotating mandrel which moves a tray blank through a forming station including a plurality of folding fingers, folding guides and rollers arranged along an arcuate path. A movable cam operated clamp on the mandrel holds the tray blank on the mandrel until the mandrel reaches the discharge station.

This clamp is not used for forming any portion of the tray box. Similarly, in U.S. Pat. No. 3,683,755 issued to Lattke on Aug. 15, 1972, the mandrel of a rotary tray former engages a tray blank and passes through an arcuate shaped forming station. The tray is removed from the mandrel by an eject mechanism housed within the mandrel. Thus, these rotary tray formers experience the same disadvantages discussed above.

In several prior art patents, parts of a rotary tray former have been reorientated to overcome some of the disadvantages discussed above. For example, in U.S. Pat. No. 2,821,054 issued to Ritscher on Jan. 28, 1958, a rotating plate adjacent the mandrel for holding the completed package is shown which is partially reoriented for the purpose of removing the package from the rotary tray former. After the mandrel drops the completed package on this separate rotating plate, the rotating plate is briefly reoriented by a cam mechanism to a position parallel to a conveyor belt on which the completed package is placed. However, rather than reorientating the mandrel itself during the formation of the package, the elements which perform the package forming function rotate with the mandrel. In U.S. Pat. No. 2,931,276 issued to Zerlin on Apr. 5, 1960, a rotary tray former is shown in which two or more mandrels are mounted on a support wheel which is pivotally mounted on a rotating lever. As the lever rotates, the support wheel engages a segmented gear mounted on a portion of the circumference of the circular path of the lever. The interaction between the support wheel and the segmented gear pivots the support wheel and the mandrels mounted thereon in order to enable the mandrels to travel different forming paths during successive rotation cycles of the lever. However, since the mandrels in Zerlin are not reoriented while passing through the forming station, the Zerlin tray former does not overcome the disadvantages of an arcuate shaped forming station.

Other prior art attempts to overcome the disadvantages of an arcuate shaped forming station have been directed to enabling the mandrel to provide many of the tray forming functions. For example, a sophisticated mandrel which performs all the tray or package forming functions is shown in the Ritscher patent cited above. The mandrel includes a plurality of forming plates which are movable on the mandrel in response to the movement of a plurality of cams in a stationary cam track. As the mandrel reaches a designated point in the rotation cycle, the cams drive the forming plates which form the package without relying on any fixed forming elements along the arcuate path of the mandrel. Similarly, the Zerlin patent cited above shows a movable pressure lever associated with the mandrel for securing the seam of the container. This pressure lever also is actuated by a rotating cam positioned in a stationary cam track. Although rotary tray formers with cam operated forming elements overcome the disadvantages of an arcuate forming path for the rotating mandrel, these cam mechanisms have several disadvantages. In particular, these cam mechanisms are very difficult and expensive to manufacture. As a result, rotary tray formers with cam operated forming elements attached to the rotating mandrel have not been particularly successful.

It is therefore an object of this invention to provide a rotary receptacle former which overcomes the above disadvantages of the prior art. In particular, it is an object of the present invention to provide a rotary receptacle former in which the mandrel makes a straight line pass through the forming station. In this regard, the orientation of the mandrel of the rotary receptacle former is fixed with respect to the forming station as the mandrel moves in a circular path through the forming station. In addition, it is an object of this invention to provide a movable die at the forming station which tracks the movement of the mandrel by moving radially of the circular path of the mandrel. The object of the combined operation of the mandrel and the movable die is to achieve a straight line pass of the mandrel through the die in order to avoid the prior disadvantages of an arcuate forming path in a rotary receptacle former.

Another object of the present invention is to provide a rotary receptacle former in which the completed receptacle can be quickly and easily removed from the mandrel without interfering with the continuous movement of the mandrel in a circular path. In particular, it is an object of the invention to maintain the mandrel in a fixed orientation with respect to the receptacle removal station as it passes through such station in order to permit a receptacle removal mechanism to remove the completed receptacle from the mandrel without interfering with the continuous movement of the mandrel in the circular path.

An object of the present invention is to provide a mandrel for a rotary receptacle former which has forming elements movable thereon for forming a portion of the receptacle. As a result, the functions of the stationary forming elements in the die can be simplified which results in an increase in the speed of operation of the rotary receptacle former. In particular, it is an object to drive these movable forming elements on the mandrel in response to the reorientation of the mandrel as it moves in a circular path. The disadvantages of cam actuated forming elements on the mandrel are avoided by using a plurality of rotating gears.

A further object of the present invention is to form a portion of the receptacle before the mandrel engages the receptacle blank and the die. In particular, it is an object to form a hem on the receptacle blank before it reaches the die. As a result, completely flat receptacle blanks can be used in the rotary tray former of this invention which results in reduced packing, shipment and storage costs as well as overcoming the aging factor of pre-hemmed receptacle blanks.

Other objects of the present invention include providing a unique and reliable mechanism for forming the corner tabs of the receptacle blank, applying a fast setting adhesive to selected portions of the receptacle blank before it reaches the die to enhance the speed of operation of the rotary receptacle former and providing a fast, efficient mechanism for withdrawing individual receptacle blanks from a stack of receptacle blanks placed on the rotary receptacle former. These and other objects are accomplished by the rotary tray former of the present invention.

SUMMARY OF THE INVENTION

This invention is an apparatus comprising a rotary receptacle former for forming a receptacle, such as a shallow tray from a precut and prescored tray blank which includes side and end walls connected to a bottom panel, a pair of corner tabs on each end of the tray blank connected to the side walls, an end flap connected to each of the end walls and a pair of corner hinges connected to each end flap on perforated connection lines. The tray blanks are stacked on a pair of blank support arms which oscillate to prevent the tray blanks from sticking together in the stack. A plurality of vacuum cups mounted to rock back and forth into engagement with individual ones of these tray blanks separate the bottom tray blank from the stack. A continuously rotating feed wheel then directs the tray blank to a feeding mechanism which conveys the tray blank to a forming station comprising a die. Adhesive applicators and a hem forming mechanism are associated with the feeding mechanism. The hem forming mechanism includes a plurality of plows and rollers which bend and fold a portion of the tray blank on the adhesive. In this manner, a hemmed tray blank is positioned on the die. As the tray blank enters the die, the pair of corner tabs on the leading edge of the tray blank are partially folded by a pair of ramps. The corner tabs on the other end of the tray blank are folded by deflector bars underneath the tray blank as a mandrel moving in a circular path engages the tray blank. These corner tabs are guided by tab deflectors on the die into a latch on the mandrel which latches the corner tabs during the movement of the mandrel through the die. The mandrel is pivotally mounted on a turret which rotates the mandrel about a stationary shaft. The mandrel is maintained in a fixed orientation with respect to the die by the planetary motion of a gear attached to the mandrel about a stationary sprocket gear on the turret shaft. The planetary gear is connected to the stationary sprocket gear by a flexible chain. In addition, the die is capable of moving radially of the circular path of the mandrel to track the movement of the mandrel. The combined effect of the fixed orientation of the mandrel and the tracking movement of the die results in a straight line movement of the mandrel through the die. This interaction of the die and the mandrel forms the end and side walls of the tray. As the mandrel leaves the die, clamping fingers on the mandrel clamp the end flaps of the tray blank and corner blocks movable on the mandrel fold the corner hinges. The clamping fingers and the corner blocks on the mandrel are driven by a second planetary gear associated with the mandrel which is actuated by the movement of the planetary gear used to maintain the mandrel in a fixed orientation with respect to the die. Thus, all operations of the mandrel are initiated by the rotary movement of the turret upon which the mandrel is mounted. After the forming of the corner hinges, the clamping fingers and the corner blocks on the mandrel disengage the completed tray. The mandrel remains in the same fixed orientation as it continues to move in a circular path through tray removal or stripping fingers which remove the tray from the mandrel. Because of the fixed orientation of the mandrel, these stripping fingers can be positioned adjacent the circular path of the mandrel to remove the tray from the mandrel without interfering with the continuous movement of the mandrel. The completed tray is then removed from the rotary receptacle former of the present invention by a product conveyor.

DETAILED DESCRIPTION OF THE INVENTION

Figure 1:
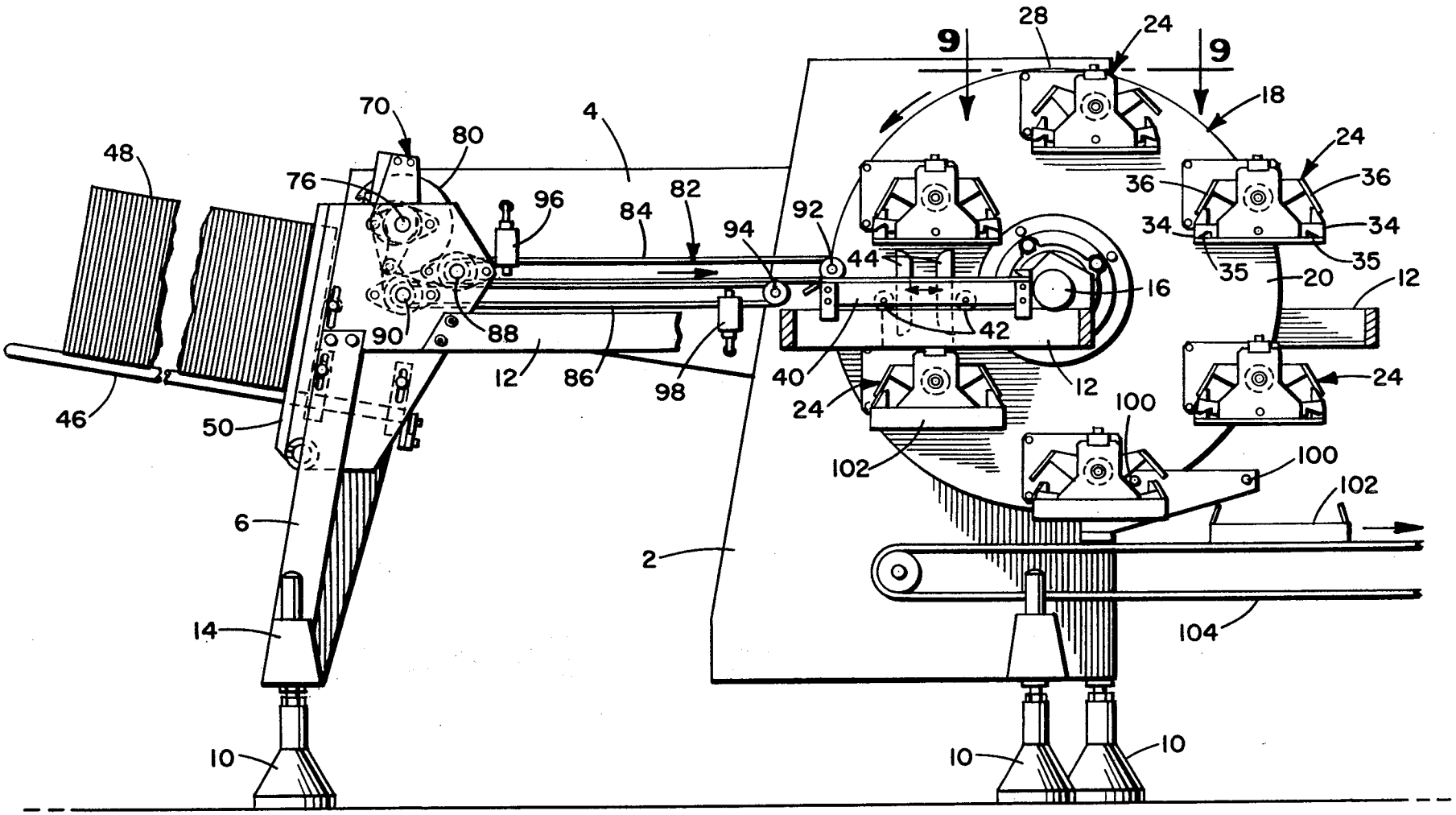
FIG. 1 is a side elevation view of the apparatus of the present invention.
Figure 2:
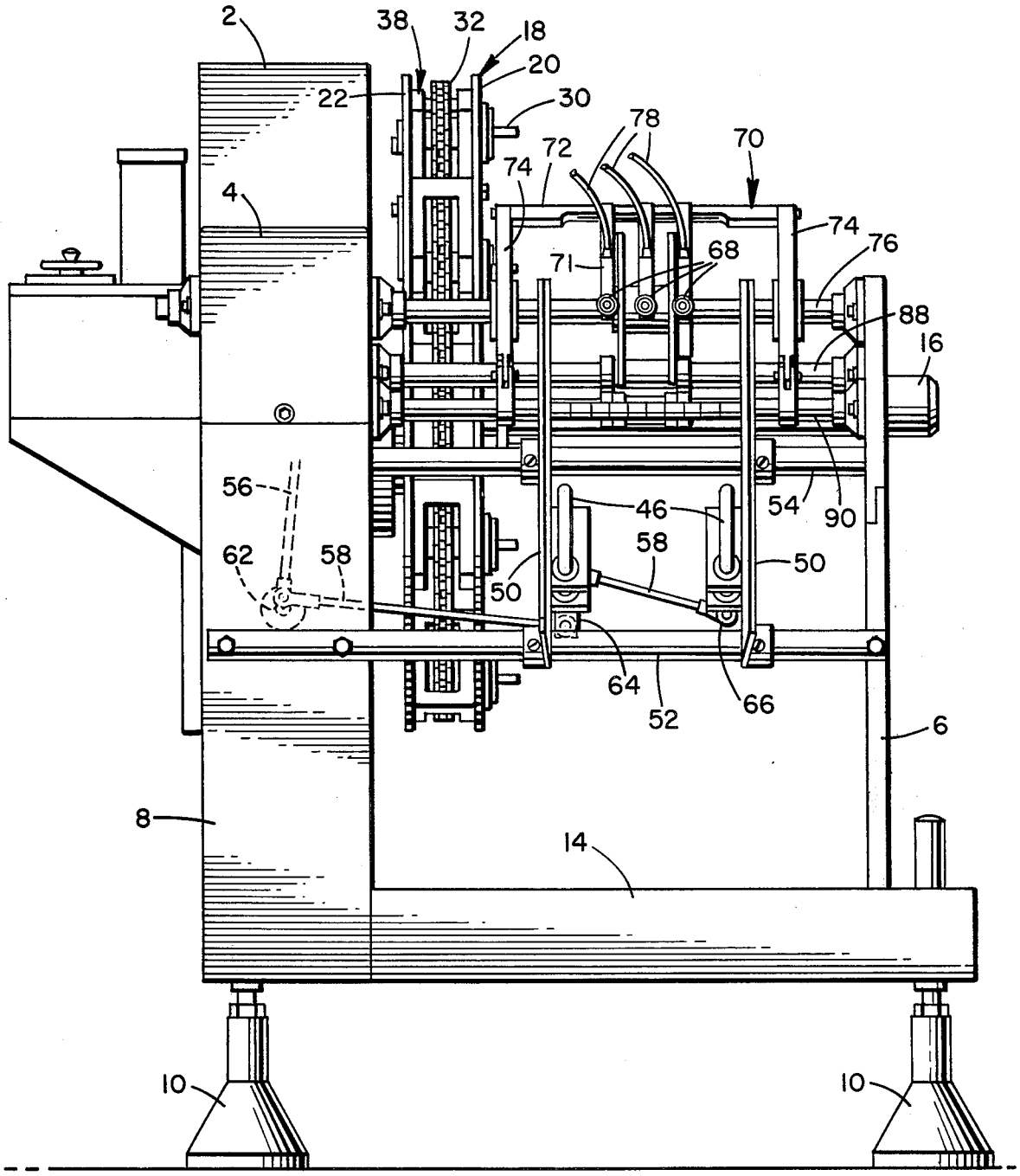
FIG. 2 is a front elevation of the apparatus shown in FIG. 1 with the mandrels removed for the sake of clarity.

The apparatus shown in FIGS. 1 and 2 is the receptacle former of the present invention which is used in the preferred embodiment to form a shallow tray. This apparatus includes an elevated main frame 2, a horizontal arm 4 and vertical frame supports 6 and 8. The frame is supported by two pairs of laterally spaced feet 10. A horizontal rail 12 intermediate the upper and lower edges of the main frame 2 is connected to the main frame 2 for supporting the die 40 of the rotary tray former described below. A portion of this horizontal rail 12 is shown in sectional view in FIG. 1 in order to permit a better overall view of the present invention. The vertical supports 6 and 8 are braced by a horizontal brace 14. A stationary turret shaft 16 which is supported by the main frame 2 has a turret 18 mounted thereon as shown in further detail in FIG. 5. The turret 18 includes a front plate 20 and a rear plate 22 which are connected together by a plurality of turret pivot assemblies 38. Each of these turret pivot assemblies 38 has a shaft 30 which supports a planetary drive transmission 28. For sake of simplicity, these planetary drive transmissions 28 are not shown in FIG. 2. Each of these planetary drive transmissions 28 in turn supports a mandrel 24 on a mandrel drive shaft 26. The mandrels 24 and a die 40 supported on the horizontal rail 12 essentially form the rotary tray former of the present invention. The turret 18, which is rotated in a counterclockwise direction by the drive system shown in FIG. 3, moves the mandrels 24 in a circular path around the turret shaft 16. As the turret 18 rotates, the mandrels 24 and the planetary drive transmissions 28 pivot on the shafts 30 as shown in FIG. 1 so that the mandrels 24 and the planetary drive transmissions are maintained in a fixed orientation with respect to die 40 during the rotation cycle of the turret 18. This orientation is maintained by the interaction of a planetary drive chain 32 with the turret pivot assemblies 38 as shown in FIG. 2 and described in greater detail below with respect to FIG. 4. Each of the mandrels 24 include corner blocks 34 and clamping fingers 36 movable on the mandrels 24 as the mandrels 24 move in a circular path about the turret shaft 16. In the preferred embodiment, during one rotation cycle of the turret 18, the corner blocks 34 and clamping fingers 36 of each of the mandrels 24 complete two operation cycles as described below in further detail with reference to FIGS. 9–11 and 30–33.

Figure 29:
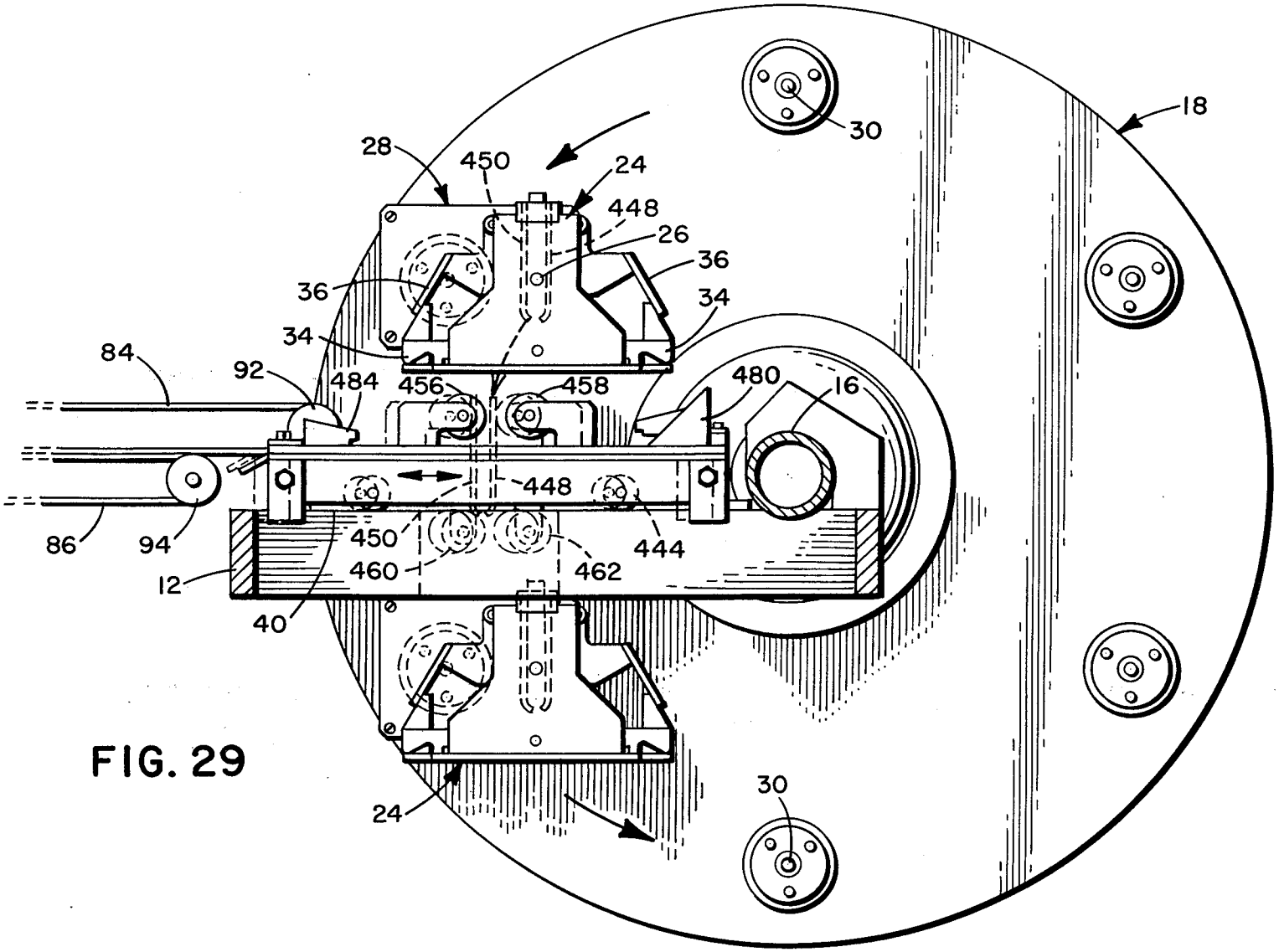
FIG. 29 is a side elevation of the turret and die taken along line 29—29 of FIG. 6B showing the die tracking the movement of the mandrel.
Figure 30:
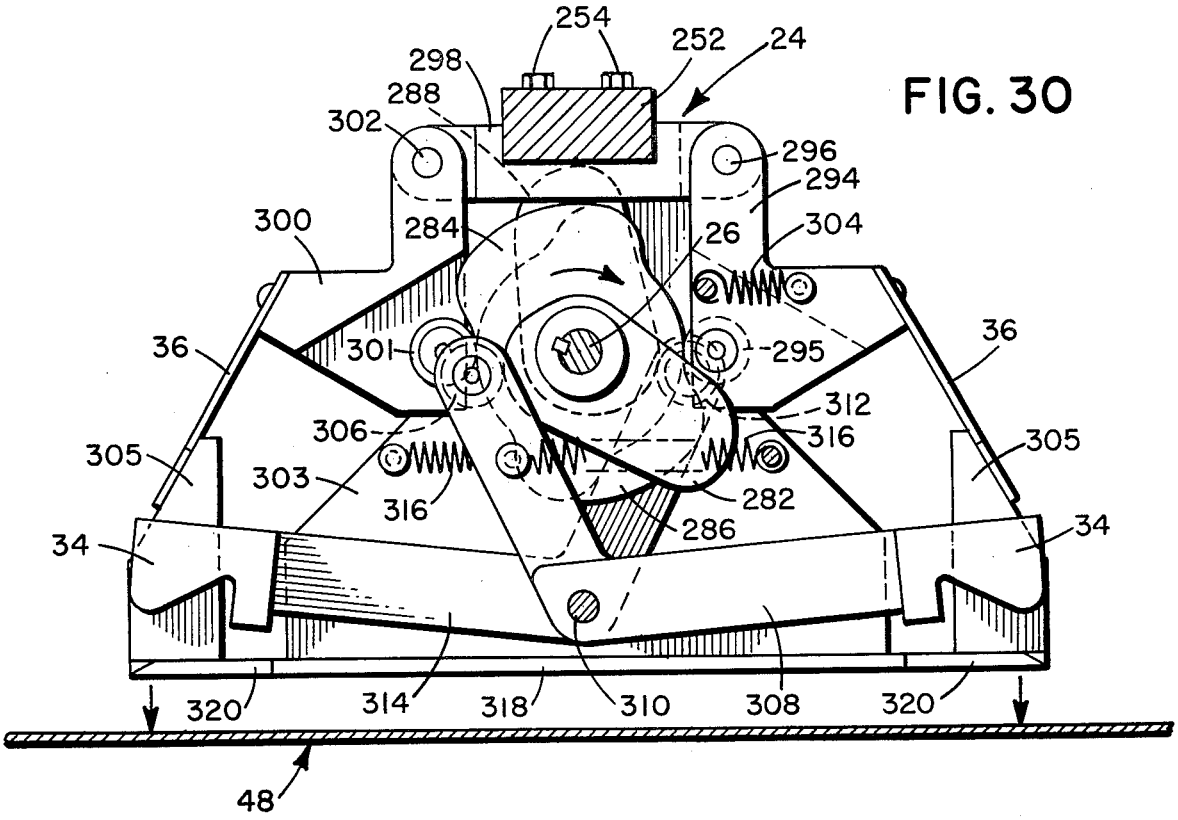
FIGS. 30–33 are front elevation views partially in section of the mandrel showing the operating sequence of the mandrel and also showing a part of the tray in cross section taken along the line 30—30 of FIG. 9.

As shown in FIG. 1, the mandrels 24 pass through a die 40 which is mounted on the horizontal rail 12 at approximately the nine o'clock position of the turret 18. The die 40 is described in greater detail below with respect to FIGS. 23–29. The die is movably mounted on the horizontal rail 12 by a plurality of wheels 42. In the embodiment shown in FIG. 1, guide members 44 on the die 40 engage a roller (not shown) on the mandrel 24 as it passes through the die 40. The interaction of the guide members 44 and the roller (not shown) on the mandrel enables the die 40 to move along the horizontal rail 12 radially of the circular path of the mandrel 24 on wheels 42. In another embodiment of the die 40 shown in FIG. 23–29, the guide wheels are mounted on the die 40 rather than the mandrel 24 and the guide members 44 are mounted on the mandrel 24. However, in both of these embodiments, the die 40 tracks the circular movement of the mandrel 24 as it passes through the die 40 as further illustrated in FIG. 29.

The horizontal arm 4 supports the feeding mechanism of the apparatus of the present invention. This feeding mechanism includes a pair of tray blank support arms 46 which support a stack of tray blanks 48. An example of a precut and prescored flat tray blank 48 used in the preferred embodiment is shown in detail in FIG. 12.

Figure 12:
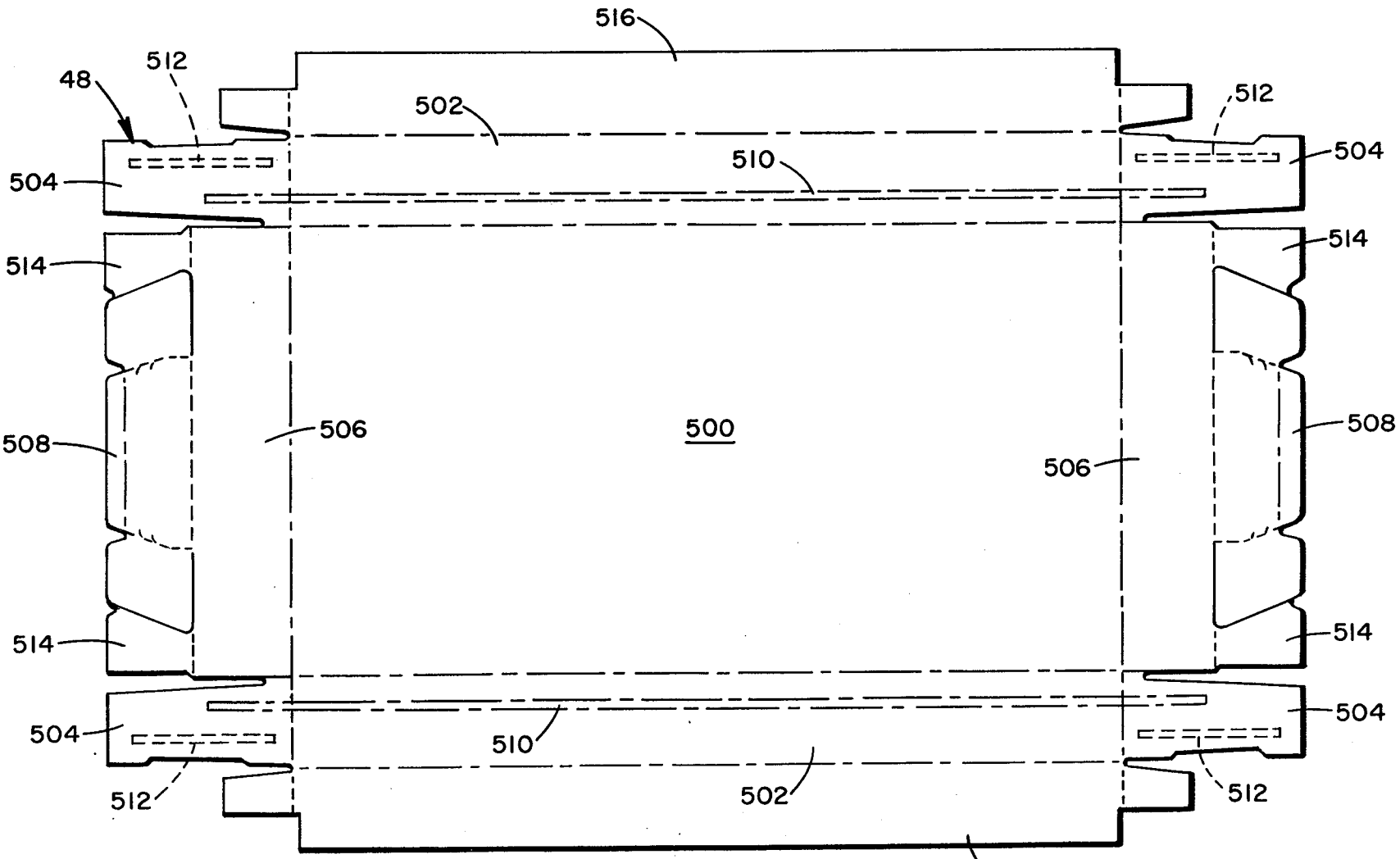
FIG. 12 is a plan view of a tray blank.
Figure 35:
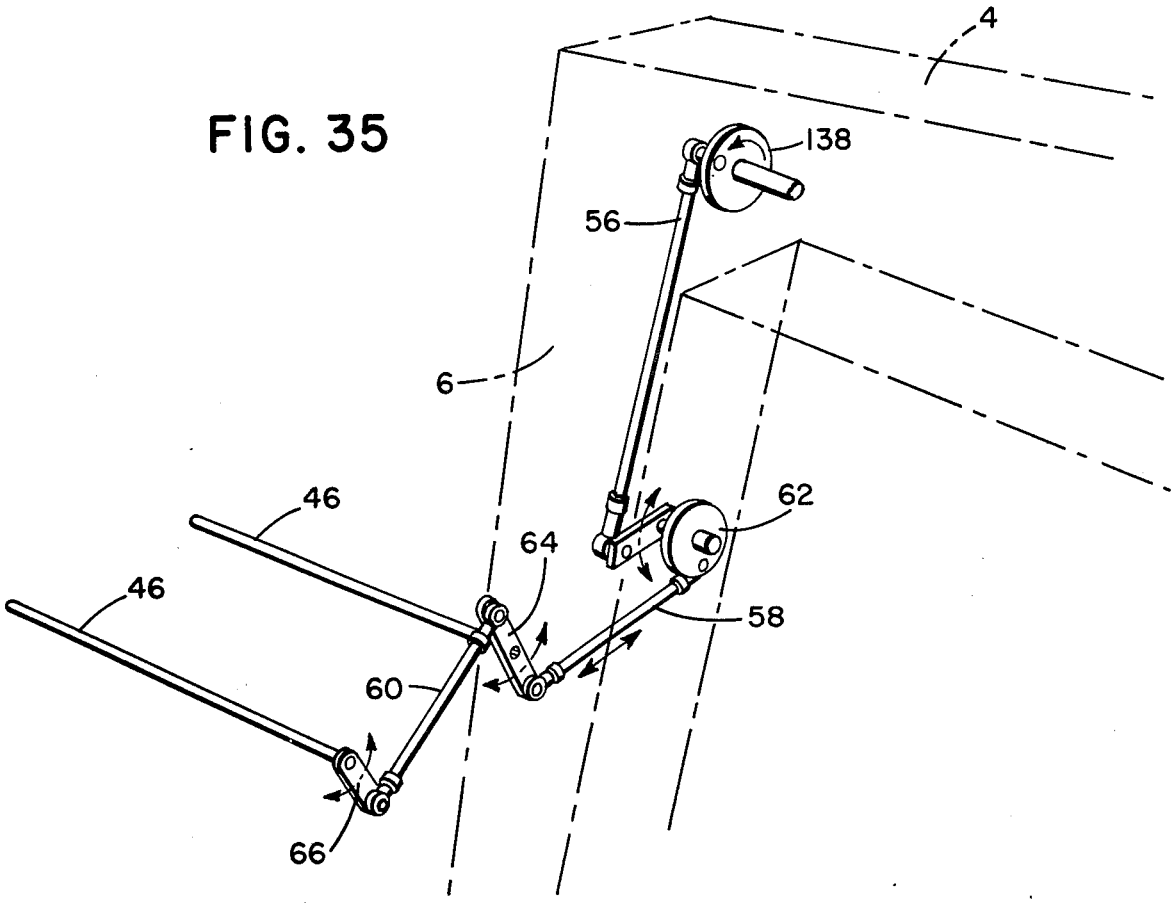
FIG. 35 is a plan view of the tray blank support arms and drive mechanism.

This tray blank 48 includes side walls 502 and end walls 506 connected to a bottom panel 500, a pair of corner tabs 504 on each end of the tray blank 48 connected to the side walls 502, an end flap 508 connected to each of the end walls 506, a pair of corner hinges 514 connected to the end flaps 506 and hem portions 516 connected to side walls 502. FIG. 12 also shows adhesive strips 510 and 512. A pair of guide plates 50 fastened to the frame by support bars 52 and 54 guide the tray blanks stacked on the support arms 46 to the feeding mechanism. As shown in greater detail in FIG. 35, the blank support arms 46 oscillate during operation of the tray former in order to prevent the tray blanks 48 from sticking together. This oscillation is generated by a crank drive arm 56 which is connected to the main drive system shown in FIG. 3. Crank drive arm 56 is connected to crank drive arm 58 by crank 62; crank drive arm 58 is in turn connected to crank drive arm 60 by rocking arm 64. The blank support arms 46 are connected to the rocking arms 64 and 66 which oscillate the support arms 46 in response to crank drive arms 58 and 60.

The tray blanks 48 are individually separated from the stack by a plurality of vacuum cups 68 supported by vacuum support arm 70 which includes a plurality of support bars 71 connected to a horizontal arm 72. The horizontal arm 72 is supported by vertical supports 74 which are pivotally mounted on shaft 76. The shaft 76 is supported by the horizontal arm 4 of the frame. Vacuum lines 78 are connected to the vacuum cups 68 for providing a vacuum to the vacuum cups 68. The vacuum support arm 70 rocks back and forth and to enable the vacuum cups 68 to periodically engage the tray blanks 48 as described in further detail below with reference to FIGS. 7–8. After one of the tray blanks 48 is separated from the stack by vacuum cups 68, feed wheels 80 shown in detail in FIG. 8 direct the tray blank 48 onto the feed conveyor 82 which includes an upper feed belt 84 and a lower feed belt 86. The upper conveyor belt 84 is driven by the rotation of shaft 88 and the lower conveyor belt 86 is driven by the rotation of shaft 90. These conveyor belts 84 and 86, which are supported at the other end by rollers 92 and 94, transport the tray blank 48 to the die 40.

Figure 13:
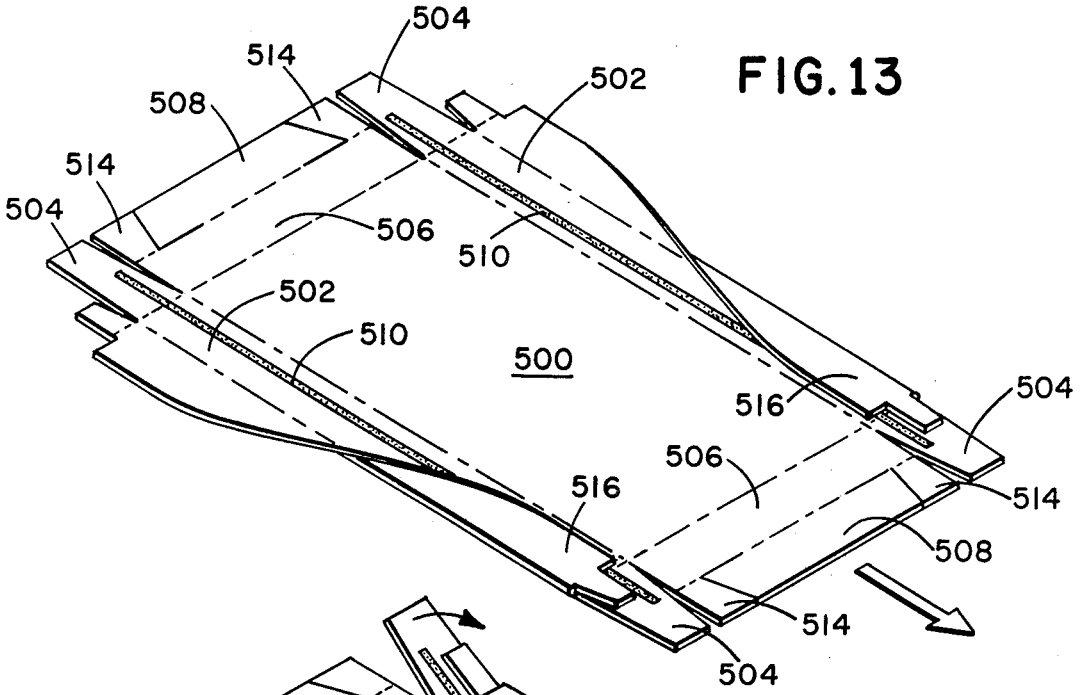
FIG. 13 is an isometric view of the tray blank shown in FIG. 12 which shows the forming of the hem of the tray blank as it is fed to the die by the feeding mechanism of FIGS. 6A and B.

As the tray blank 48 is fed by the feeding mechanism 82 to the die 40, adhesive applicators 96 and 98 apply an adhesive to selected portions of the tray blank 48. In addition, a plurality of rollers and plows not shown in FIG. 1 but described in greater detail below in reference to FIGS. 6 and 17–22 form a hem on a portion of the tray blank 48. A hemmed tray blank 48 is shown in FIG. 13.

Figure 14:
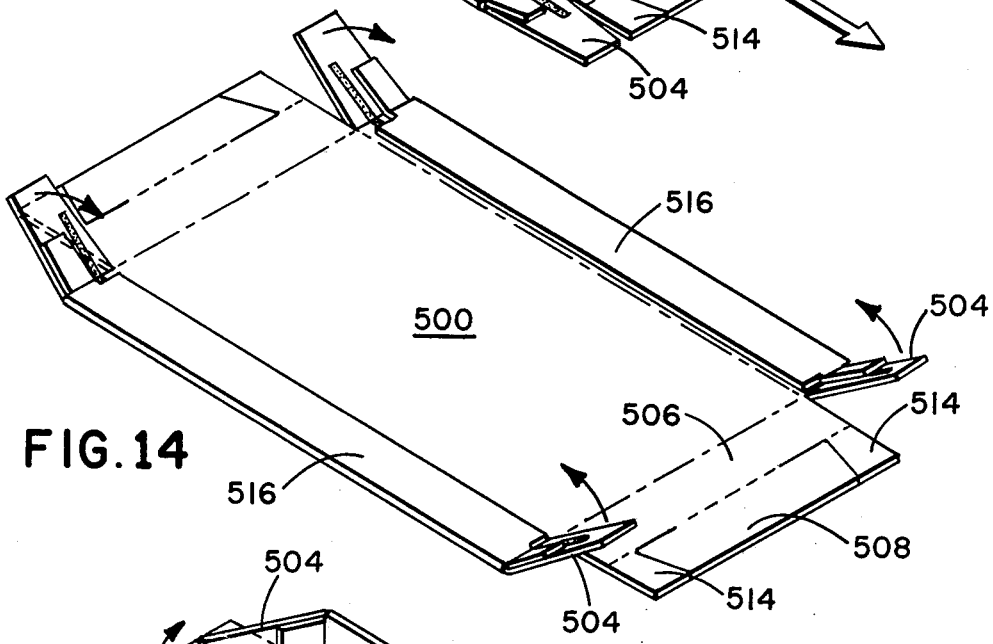
FIGS. 14–16 are isometric views of the tray blank showing forming of the tray by the die and mandrel of the present invention.
Figure 16:
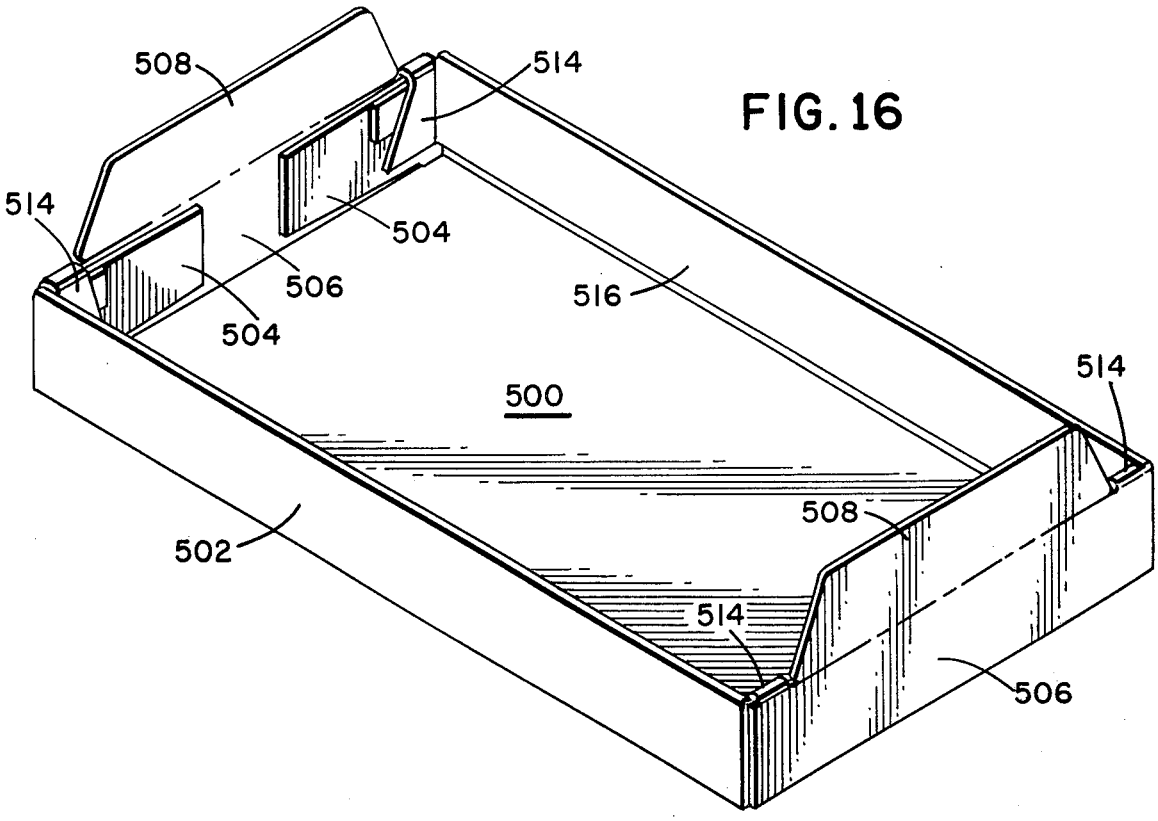

The operation of the apparatus shown in FIGS. 1 and 2 is now briefly described. One of the stacked tray blanks 48 on blank support arms 46 is separated from the stack by vacuum cups 68 and feed wheels 80. The feed wheels 80 direct the tray blank 48 onto feed conveyor 82 which transports the tray blank to die 40. Adhesive applicators 96 and 98 apply adhesive to selected portions of the tray blank 48 and a hem is formed on the tray blank before the tray blank reaches die 40. One of the mandrels 24 engages the tray blank 48 supported on the die 40 and the interaction of the mandrel 24 and the die 40 forms the side walls 502, the end walls 506 and the corner tabs 504 of the tray blank 48 as shown in FIGS. 13–14. During this interaction of the die 40 and the mandrel 24, the die 40 tracks the circular movement of the mandrel 24 by moving radially of this circular path along the horizontal support rail 12 on wheels 42. Simultaneously, the mandrel 24 is maintained in a fixed orientation with respect to the die 40 as the mandrel passes through the die 40 so that the relative movement of the mandrel 24 with respect to the die 40 forms a straight line. After the mandrel 24 passes through the die 40, the clamping fingers 36 and corner blocks 34 on the mandrell 24 are actuated to form the corner hinges 514 as shown in FIG. 16. As the mandrel 24 continues to move in the circular path beyond the six o'clock position of the turret 18, the clamping fingers 36 and corner blocks 34 are disengaged and the tray is removed from the mandrel by tray stripping fingers 100 which are shown in greater detail in FIG. 34. The completed tray 102 is then transported on a product conveyor belt 104 for removal from the apparatus of the present invention.

Figure 3:
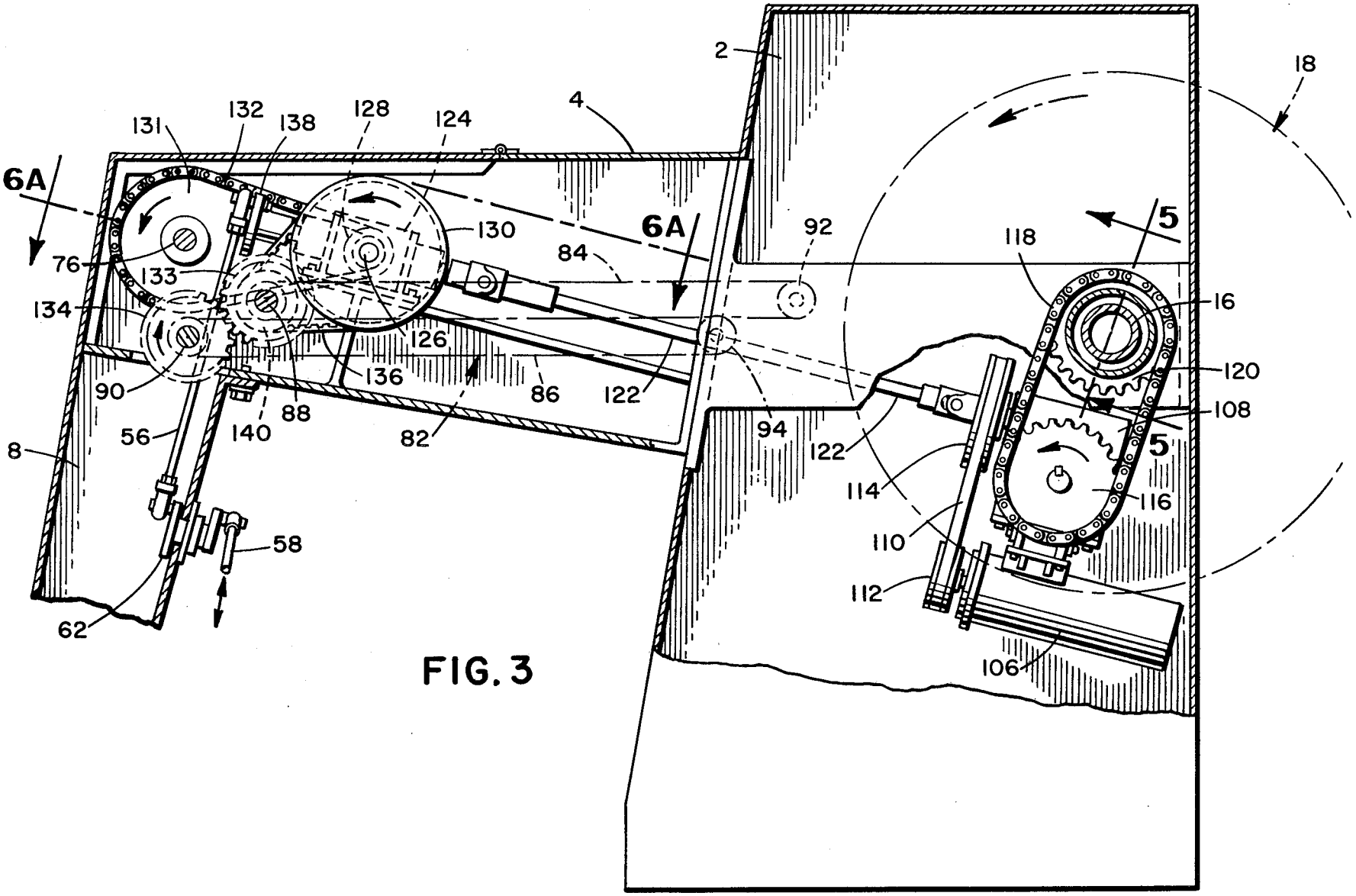
FIG. 3 is a side elevation, partially in section, showing the main drive system for the turret and feed mechanism of the apparatus of FIG. 1.

The drive system for the turret and the feed mechanism is shown in section in FIG. 3. The apparatus of the present invention is powered by a DC motor 106 supported by the main frame 2. The DC motor 106 drives a transmission 108 by driving a timing belt 110 which connects a pulley 112 on the DC motor 106 with a pulley 114 on the transmission 108. The transmission 108 in turn rotates a power gear 116 connected thereto in a counterclockwise direction. The power gear 116, which is connected by turret drive chain 118 to turret drive gear 120, rotates the turret drive gear 120 which is rigidly connected to the turret 18. As a result, the turret 18 rotates in a counterclockwise direction as shown in FIG. 3.

Figure 6A:
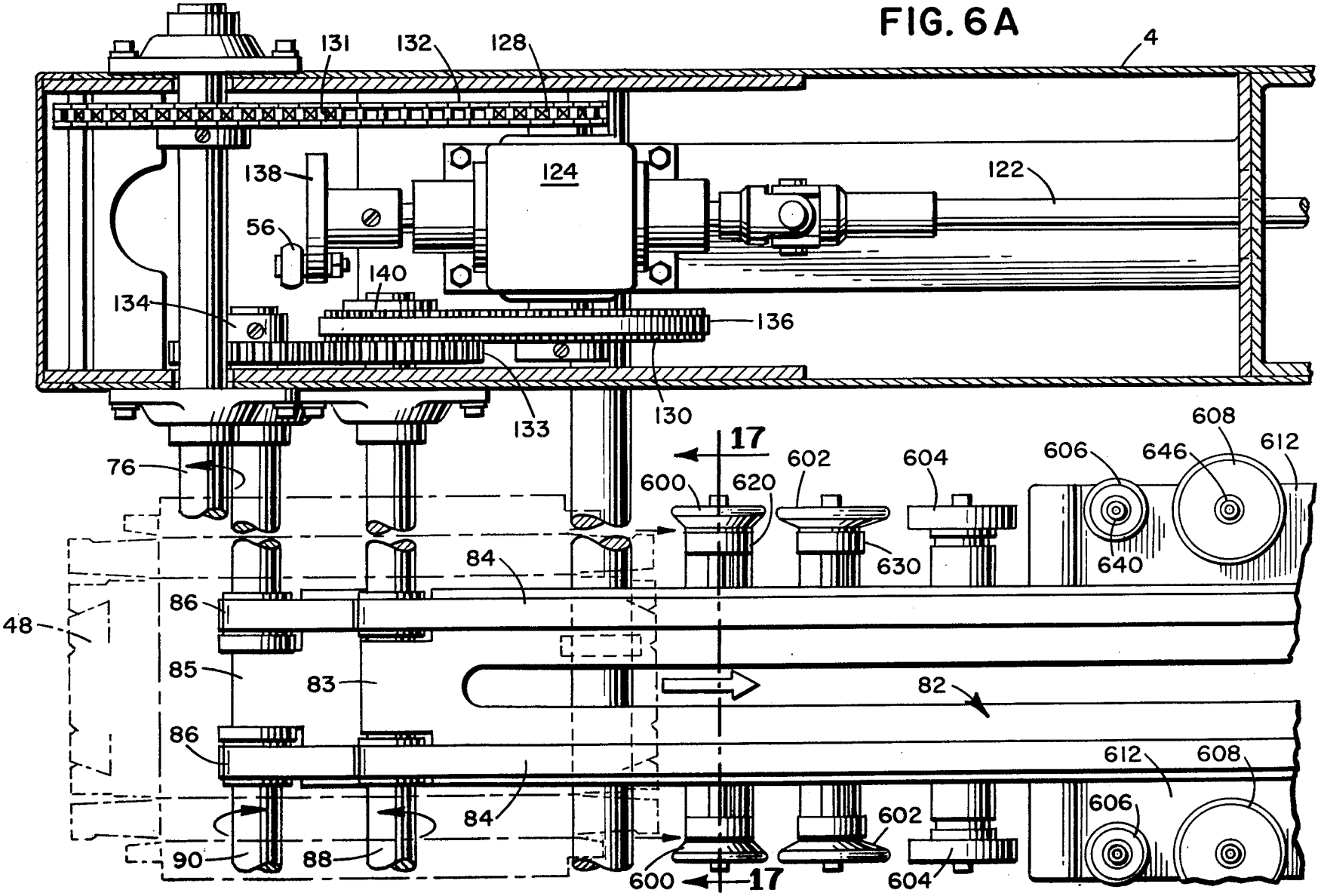
FIG. 6A is a horizontal sectional view of the feed mechanism taken along line 6—6 of FIG. 3.

The DC motor 106 also drives the feeding mechanism as shown in FIG. 3 and FIG. 6A which is a horizontal sectional view taken along line 6—6 of FIG. 3. The DC motor 106 drives pulley 114 which is connected directly to the drive shaft 122. The rotation of the drive shaft 122 by the pulley 114 provides power to the feeding mechanism transmission 124. The transmission 124 drives a shaft 126 which is connected to gears 128 and 130. The gear 128 which is connected to feed wheel gear 131 by chain 132 drives the feed wheel gear 131 and the feed wheel shaft 76 rigidly attached thereto. The rotation of the feed wheel gear 131 and the feed wheel shaft 76 enables the feed wheels 80 to direct individual ones of the tray blanks 48 from the stack of tray blanks 48 to the feeding mechanism 82. On the other hand, the gear 130 drives a timing belt 136 linked with gear 140 which in turn drives the spur gears 133 and 134. The spur gears 133 and 134 are rigidly attached to the upper conveyor belt shaft 88 and the lower conveyor belt shaft 90, respectively. The counterclockwise rotation of the gear 130 of transmission 124 rotates the spur gear 133 in a counterclockwise direction and the spur gear 134 in a clockwise direction. As a result, the upper conveyor belt shaft 88 rotates in a counterclockwise direction and lower conveyor belt shaft 90 rotates in a clockwise direction to enable the conveyor belts 84 and 86 to feed the tray blanks 48 to the die 40 shown in FIG. 1. Conveyor plates 83 and 85 provide additional support for the tray blank as it is fed by the conveyor belts 84 and 86. In addition to driving the gears 128 and 130, the transmission 124 also drives a drive wheel 138 which is connected to crank arm 56 for oscillating the blank support arms 46 as illustrated in greater detail in FIG. 35.

Figure 7:
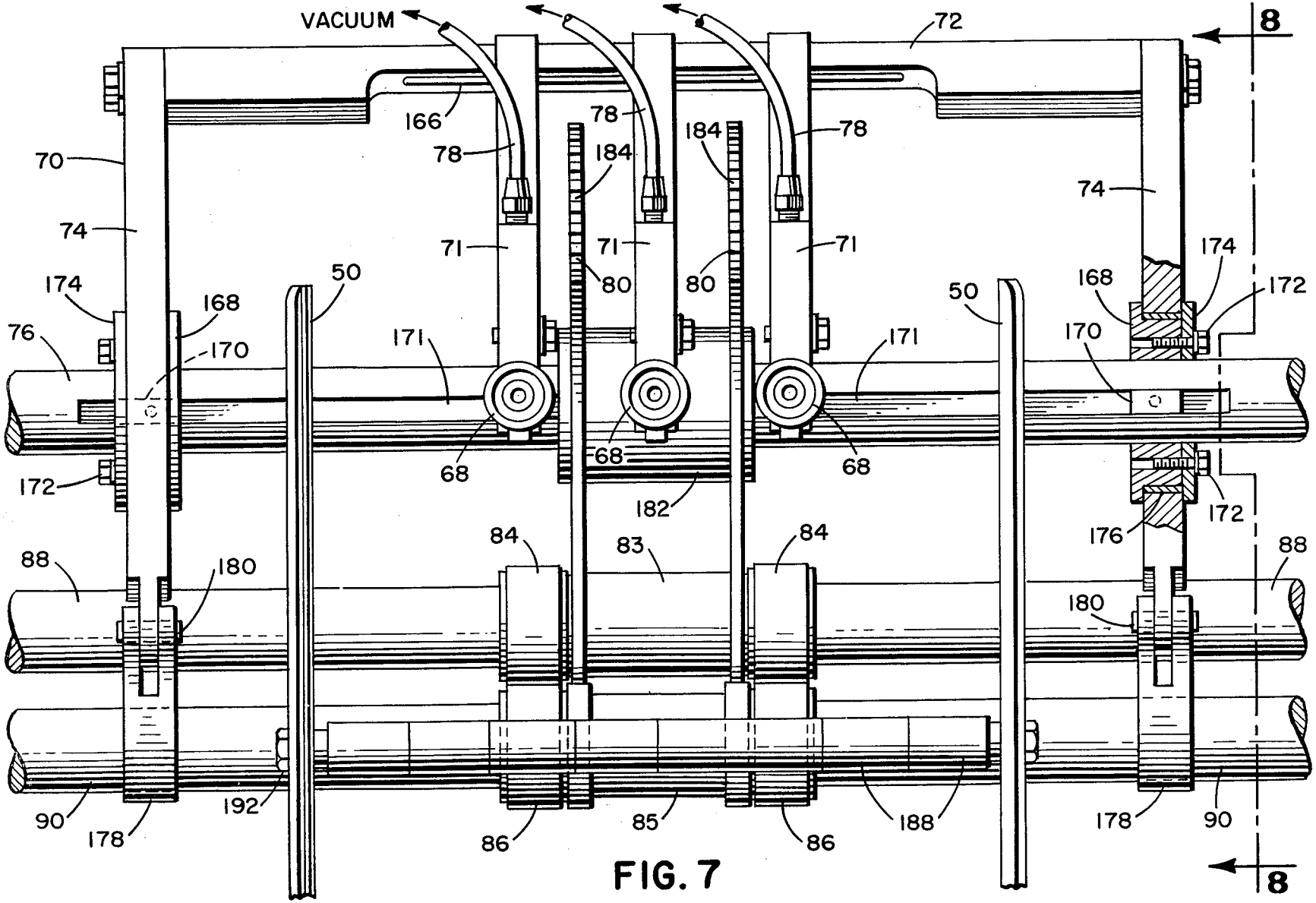
FIG. 7 is an enlarged front elevation view of the feed mechanism shown in FIG. 2.
Figure 8:
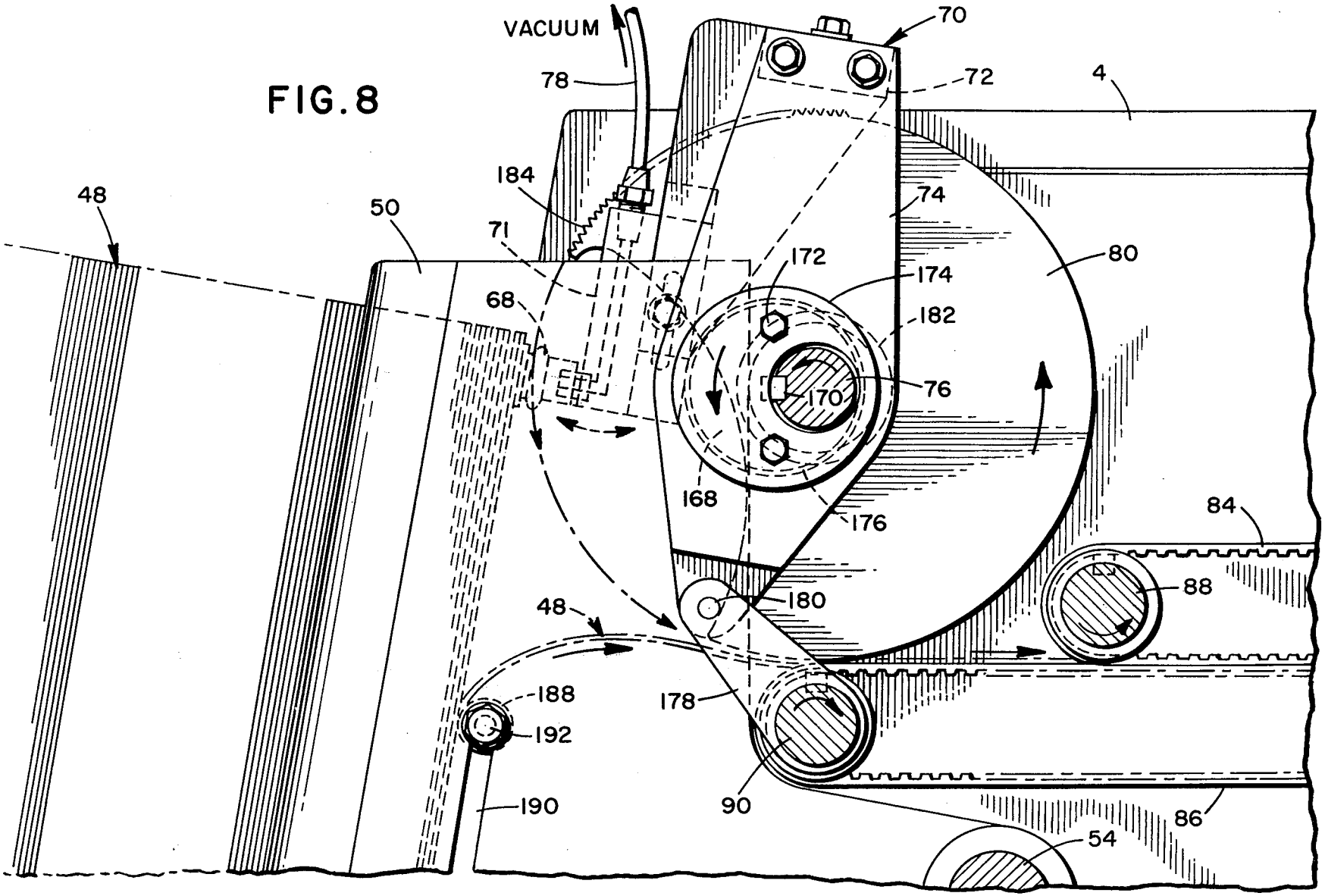
FIG. 8 is a vertical sectional view of the feed mechanism taken along line 8—8 of FIG. 7.

The operation of the vacuum cups 68 and the feed wheels 80 of the feed mechanism is shown in detail in FIGS. 7 and 8. As described previously, each of the vacuum cups 68 is fastened to a vacuum support bar 71 which is suspended from a horizontal arm 72. Vacuum lines 78 provide a vacuum to each of the vacuum cups 68. The vacuum support bars are adjustably mounted in slot 166 in the horizontal arm 72. The horizontal arm 72 is supported by vertical supports 74 which are pivotally mounted on a disk 168 which is fastened to the feed wheel shaft 76. In a sectional view of the disk 168 shown in FIG. 7, a separation ring 176 permits the disk 168 to rotate freely within the vertical supports 74. This sectional view also shows that the disk 168 is fastened to the vertical supports 74 by bolts 172 and plate 174. This disk 168, which is fastened to the feed wheel shaft 76 by a key 170 in a key way 171, moves in an eccentric path as the feed wheel shaft 76 rotates in a counterclockwise direction. This eccentric movement of the disk 168 within the vertical supports 74 enables the vertical supports 74 to rock back and forth as the disk 168 is rotated in the counterclockwise direction by the feed wheel shaft 76. The rocking action of the vertical supports 74 is transferred to the vacuum cups 68 which are attached to the vertical supports 74 by support bar 71 and horizontal arm 72. This rocking action is controlled and limited by an anchor link 178 which is attached to the vertical supports 74 by a pin 180. The other end of the anchor link 178 is freely mounted on the lower conveyor shaft 90. The anchor link 178 controls the relative position of the bottom portion of the vertical supports 74 so that the position of the vacuum cups 68 with respect to the tray blanks 48 is precisely controlled. As a result, each rotation of the feed wheel shaft 76 and the disk 168 enables the vacuum cups 68 to engage one of the tray blanks 48 and separate this tray blank 48 from the stack. Upon separation of one of the tray blanks 48 from the stack, the cutout portion of the feed wheel 80 shown in FIG. 8 engages the tray blank 48 and bends it in a downward direction toward the conveyor belts 84 and 86. The feed wheels 80 are mounted on a cylinder 182 which is rotated by the feed wheel shaft 76. A portion 184 of the circumference of the feed wheels 80 is serrated for making positive contact with the tray blank 48 after the cutout portion of the feed wheels 80 initially forces the tray blank 48 to bend in a downward direction. The tray blanks are guided into position on the conveyor belts 84 and 86 by vertically mounted guide plates 50. These guide plates 50 are mounted on the vertical frame supports 6 and 8 by an upper support bar 54 and a lower support bar 52. A tray roller 186 having a plurality of freely rotatable cylinders 188 assists the free movement of the tray blank 48 from the stack to the conveyor belts 84 and 86. The tray roller 186 is vertically adjustable in the slot 190 by bolt 192.

Figure 6B:
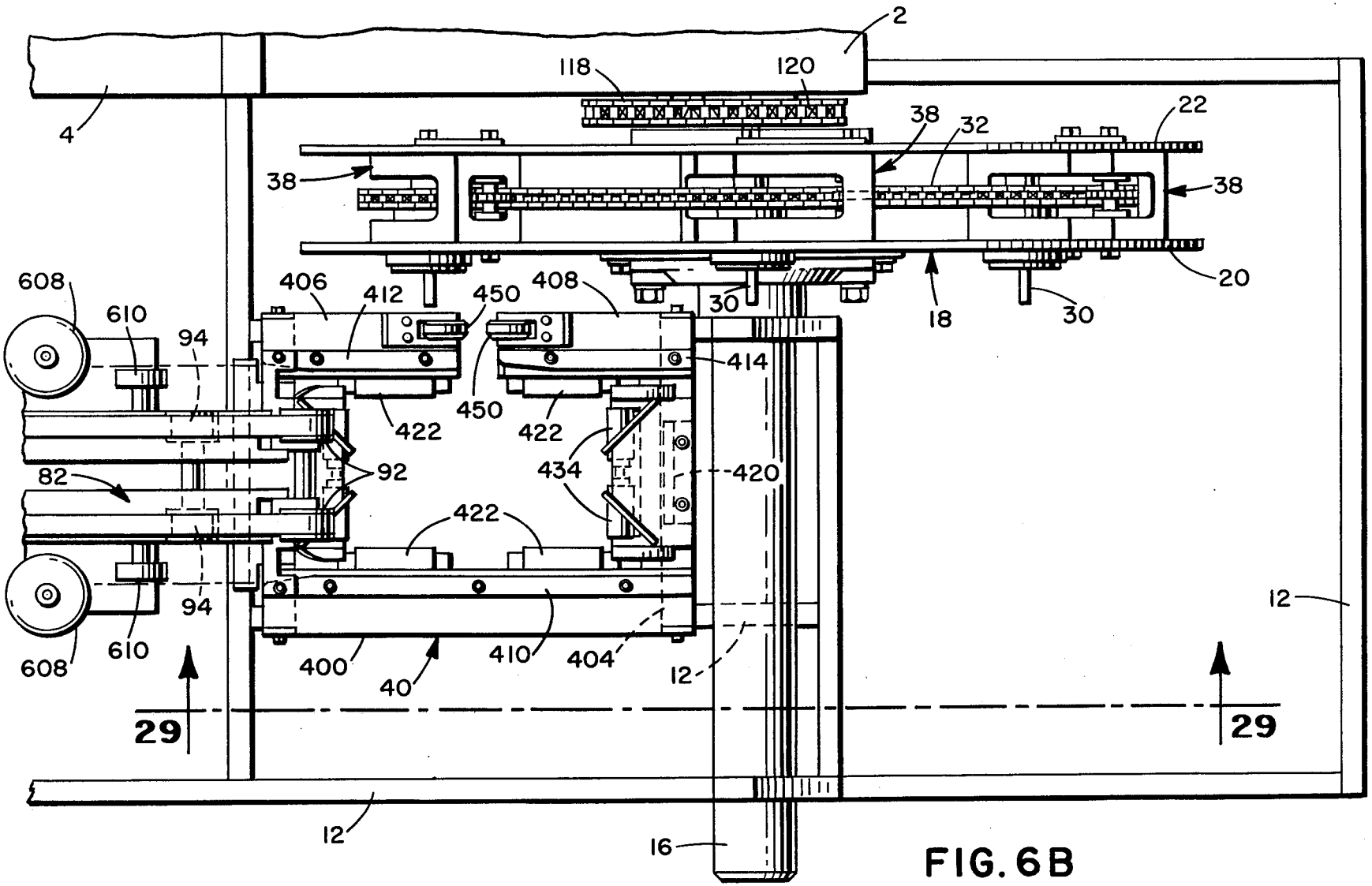
FIG. 6B is a view similar to FIG. 6A of the turret drive system and a top view of the die without the corner tab forming elements.
Figure 18:
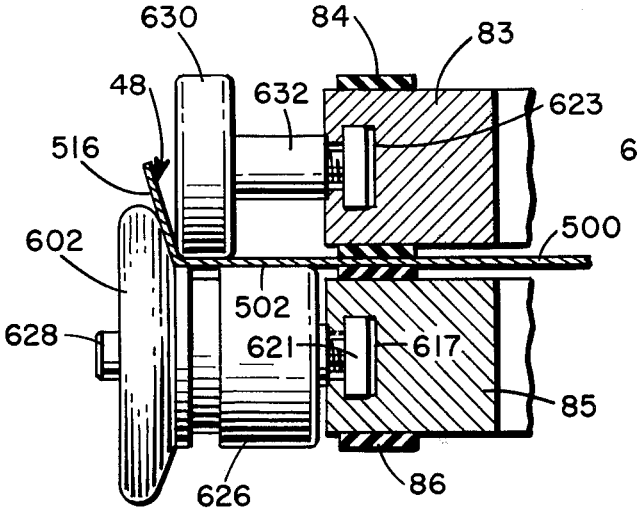
Figure 20:
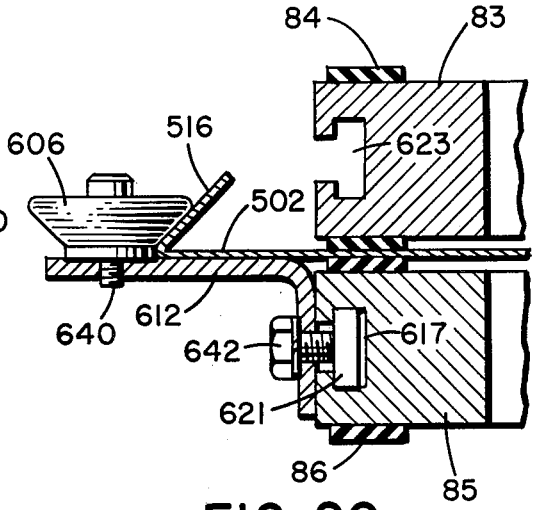
Figure 19:
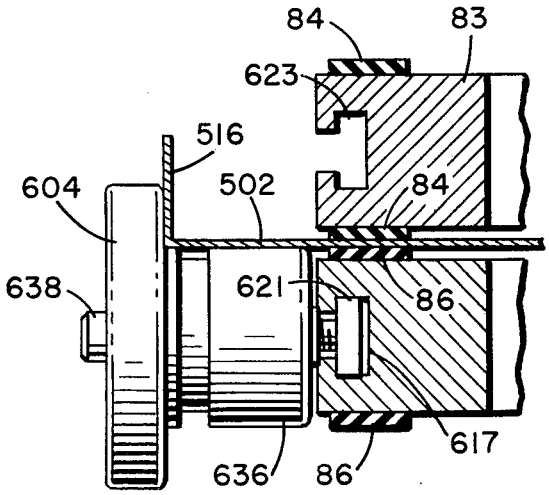
Figure 21:
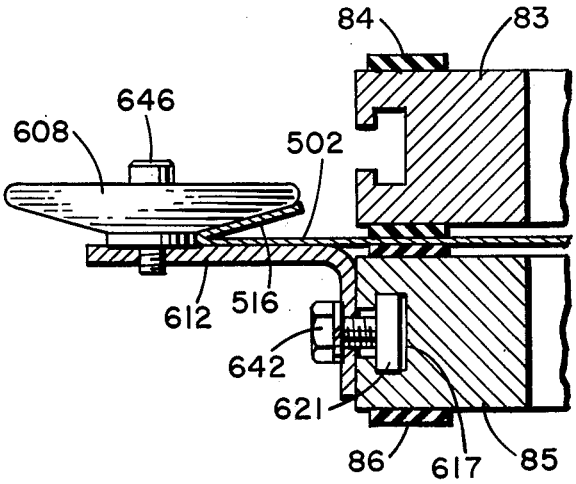

As the feeding mechanism described above feeds a tray blank 48 from the stack of tray blanks to the die 40, a plurality of pairs of plows 600, 602, 604, 606, 608 and 610 shown in top view in FIGS 6A and 6B form a hem 514 on portions of the tray blank 48 as shown in FIG. 13. A cross sectional view of each of these plows 600–610 is shown in FIGS. 17-22. Referring first to the plows 600 shown in FIG. 17, the plows 600 are rotatably mounted on bolts 616 which are adjustably secured by nuts 621 in slots 617 in the lower conveyor plate 85. These plows 600 engage the hem portions 514 of the tray blank shown in FIG. 12 and initially fold these hem portions 514 at the approximate angle shown in FIG. 17. Rollers 618 are positioned adjacent the plows 600 on the underside of the tray blank 48. These rollers 618 are rotatably mounted on bolts 616. Additional rollers 620 are rotatably mounted on bolts 622 secured in slots 623 to the upper conveyor plate 83. The function of these rollers 618 and 620 is to hold the tray blank 48 in a firm position as the plows 600 fold the hem portion 514 of the tray blank 48. The next step in the forming of the hem 514 of the tray blank 48 is shown in FIG. 18 wherein additional plows 602 and rollers 626 are rotatably mounted on bolts 628 which are rigidly secured in slots 617 to the lower conveyor plate 85. Upper rollers 630 are rotatably mounted on bolts 632 which are rigidly secured in slots 623 to the upper conveyor plate 83. The plows 602 and the rollers 626 and 630 further fold the hem portion 514 of the tray blank 48. The plows 604 shown in FIG. 19 together with rollers 636 are rotatably mounted on bolts 638 which are adjustably mounted in slots 617 in the lower conveyor plate 85. The plows 634 fold the hem portions of the tray blank 48 at right angles to the bottom panel 500. The remaining plows 606, 608 and 610 are attached to the plow support plates 612 as shown in FIGS. 6 and 20-22. The plows 606 shown in FIG. 20 are rotatably mounted on shafts 640 which are secured to plates 612. The plates 612 are adjustably mounted by bolts 642 in the slots 617 in the lower conveyor plate 85. The plows 608 shown in FIG. 21 continue to fold the hem portions 514 of the tray blank 48. These plows 608 are rotatably mounted on plates 612 by bolts 646. Finally, plows 610 shown in FIG. 22 complete the folding of the hem portions 514 of the tray blank 48 by pressing the hem portions 514 of the tray blank 48 until the adhesive previously applied in strips 510 as shown in FIG. 12 sets. Adhesive applicators 96 shown in FIG. 1 apply the strips of adhesive 510. The plows 610 are rotatably mounted on bolts 650 which are adjustably secured in slots 623 in the upper conveyor plate 83. The operation of the above plows 600-610 in forming the hem of the tray blank 48 is illustrated in FIG. 13 which shows an isometric view of the formation of the hem. As a result, the tray blank 48 which is used in the rotary tray former of the present invention has a preformed hem as shown in FIG. 14.

Figure 4:
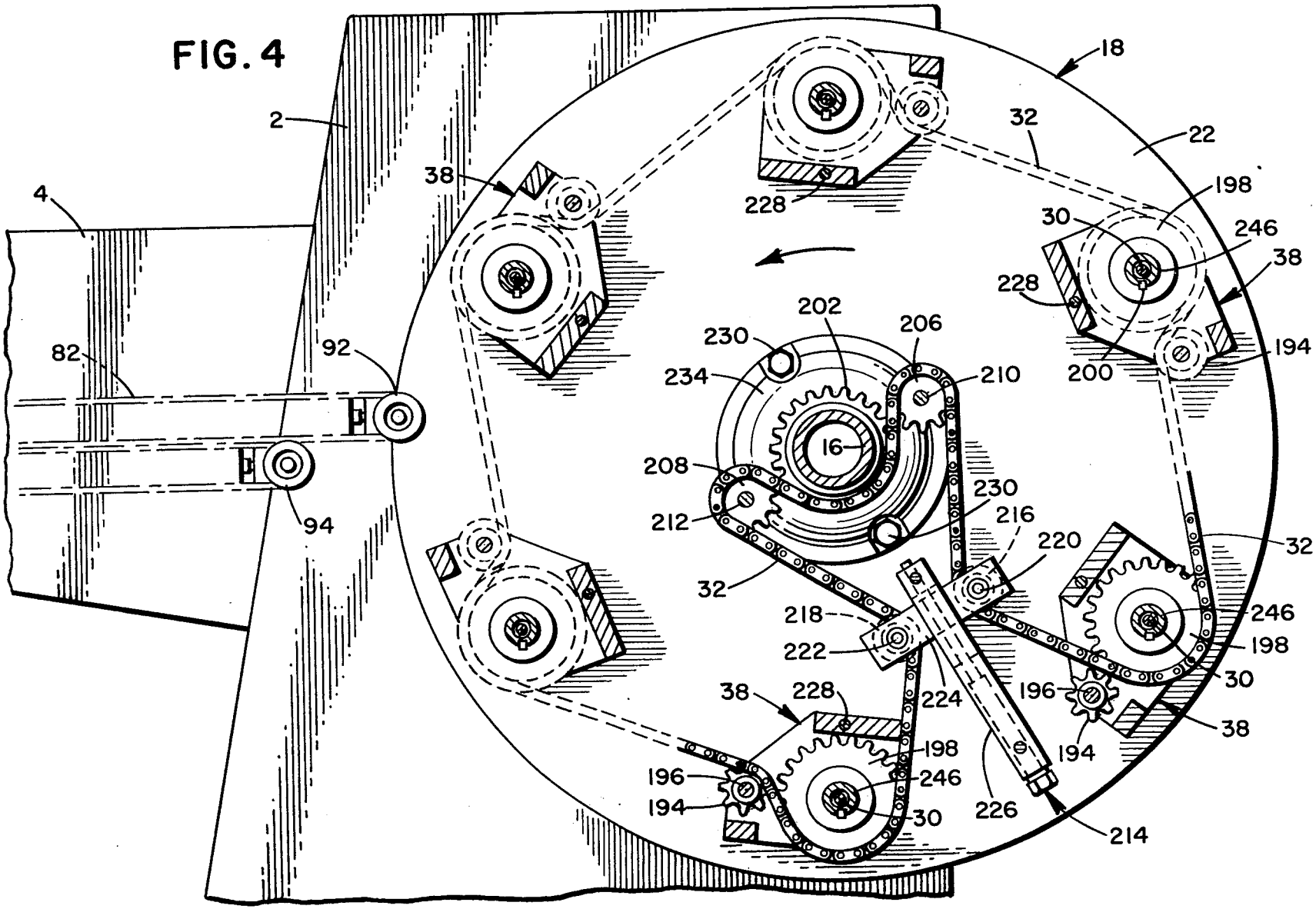
FIG. 4 is a side elevation, partially in section, showing the turret pivot assemblies and planetary drive chain.
Figure 5:
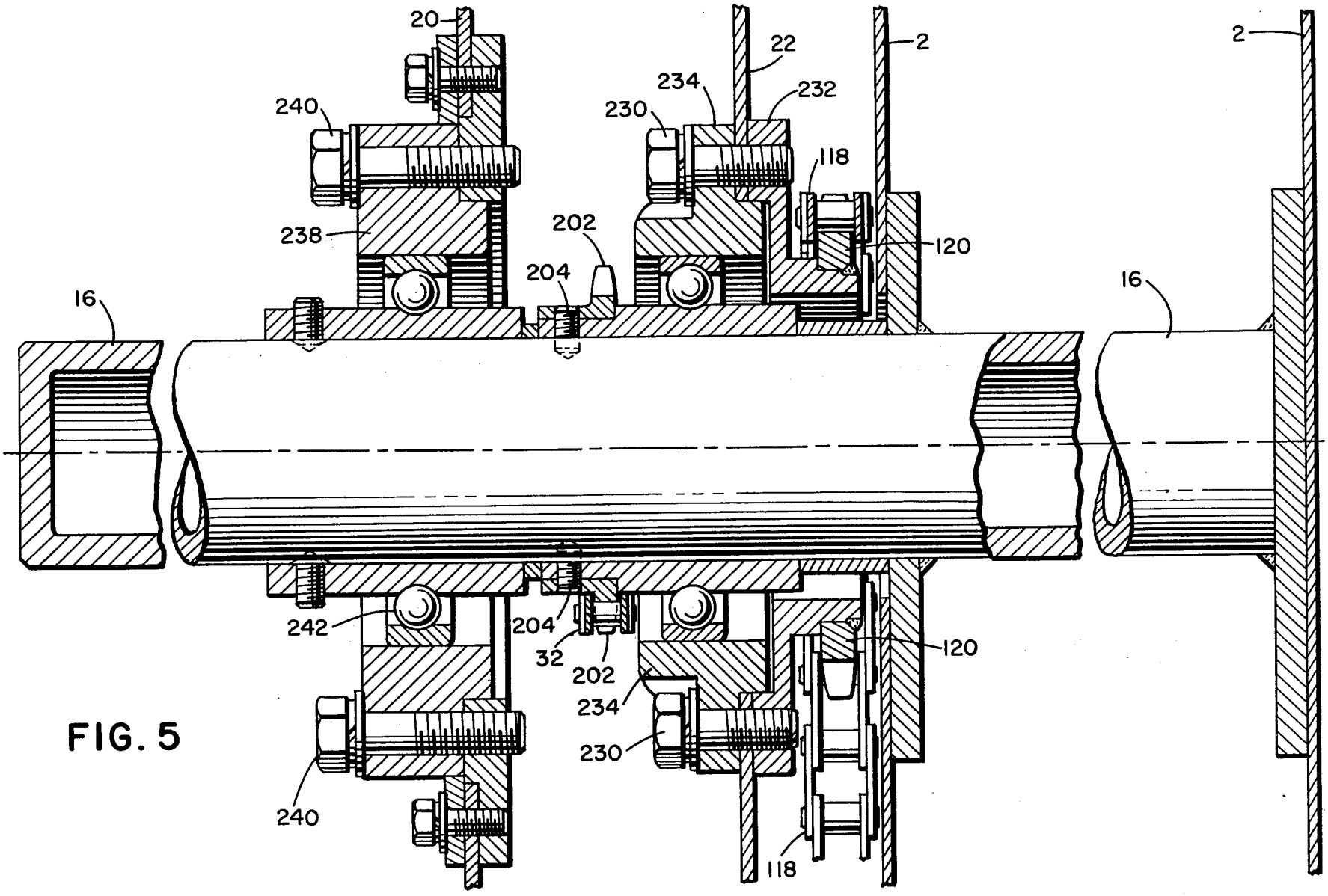
FIG. 5 is a sectional view taken along the line 5—5 of FIG. 3 showing the connection of the turret to a stationary shaft.

Returning now to the turret 18 and the mandrels 24 shown in FIG. 1 and the turret drive system shown in FIG. 3, the rotary tray former of the present invention is adapted to maintain the mandrels 24 in a fixed orientation with respect to the die 40. The mechanism for orientating the mandrels 24 is shown in detail in FIGS. 4 and 5 and 6B. Referring first to FIG. 4, a side elevation of the turret 18 is shown with the front plate 20 removed to show the turret pivot assemblies 38 and the planetary drive chain 32. Each of the turret pivot assemblies 38 is rigidly secured to the turret 18 by a plurality of bolts 228. The planetary drive chain 32 engages an idler sprocket gear 194 freely rotatable about a shaft 196 in each of the turret pivot assemblies 38. The planetary drive chain 32 also engages a planetary drive gear 198 in each of the turret pivot assemblies 38. The planetary drive gear 198 in each of the turret pivot assemblies 38 is interlocked by key 200 with the shaft 30 which supports the planetary drive transmission 28 and the mandrel 24. The planetary drive chain 32 also engages a stationary sprocket gear 202 which is rigidly attached to the stationary turret shaft 16 by bolts 204 as shown in FIG. 5. In addition, the planetary drive chain 32 engages two idler sprocket gears 206 and 208 mounted adjacent the stationary sprocket gear 202. These idler sprocket gears 206 and 208 freely rotate about shafts 210 and 212, respectively, which are rigidly attached between the front and rear plates (20, 22) of the turret 18. A chain tensioning assembly also engages the planetary drive chain 32. This chain tensioning assembly 214 includes a pair of sprocket gears 216 and 218 freely rotatable about shafts 220 and 222 which are rigidly secured to cross bar 224. The tension provided by the chain tensioning assembly 214 can be adjusted by adjusting the position of the cross bar 224 on the radial bar 226. The interconnection of the planetary drive chain 32 with the planetary drive gear 198 in each of the turret pivot assemblies 38 and the stationary sprocket gear 202 enables the planetary drive gears 198 to rotate about the shaft 30 in a clockwise direction as the turret 18 is rotated in a counterclockwise direction by the turret drive system shown in FIGS. 3 and 5. At the same time, because the position of the planetary drive gears 198 is fixed on the turret 18 by shaft 30, the planetary drive gears 198 revolve around the stationary sprocket gear 202 in a planetary motion. The gear ratio between the planetary drive gears 198 and the stationary sprocket gear 202 is set so that each of the mandrels 24 which are rigidly attached to the planetary drive gears 198 remains in a fixed orientation with respect to the die 40 as shown in FIG. 1 during the rotation of the turret 18. Thus, in the preferred embodiment, one counterclockwise rotation of the turret 18 results in one clockwise rotation of each of the planetary drive gears 198 together with their associated planetary drive transmission 28 and mandrel 24. Further details of the planetary drive gears 198 with respect to the operation of the mandrels 24 is set forth below with reference to FIGS. 9–11.

FIG. 5 shows a cross section of the turret shaft 16 including the stationary sprocket gear 202 and the turret drive gear 120 described above with reference to FIG. 3. The stationary sprocket gear 202 is rigidly secured to the shaft 16 by bolts 204 whereas the turret drive gear 120 is rotated about the stationary shaft 16 by the turret drive chain 118. The turret drive gear 120 is mounted on a plate 232 which is secured to the plate 22 of the turret 18 by bolts 230. Another plate 234 is likewise secured by bolts 230 to the other side of plate 22. The plate 234 is supported on the shaft 16 by a plurality of bearings 236 upon which the turret plate 22 and the turret drive gear 120 rotate. The front plate 20 of the turret 18 is rigidly secured to the turret plate 22 by the turret pivot assemblies 38 shown in FIG. 4. The front plate 20 is mounted on a circular plate 238 by bolts 240. The turret front plate 20 and the circular plate 238 are supported on the shaft 16 by a plurality of bearings 242. Thus, the turret 18 is rotated by turret drive 118 about the shaft 16 on bearings 236 and 242.

Figure 9:
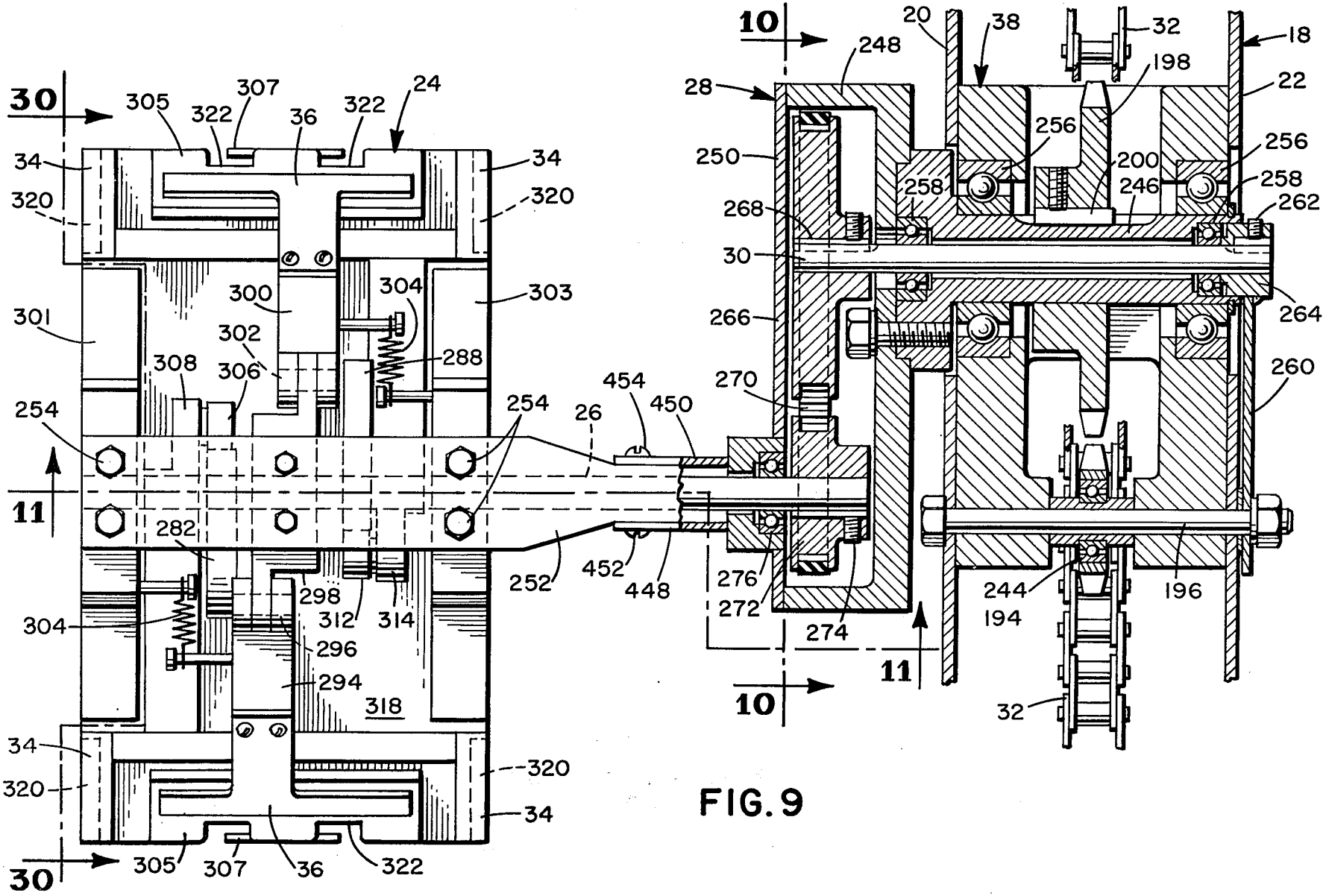
FIG. 9 is a plan view of a turret pivot assembly, planetary drive transmission and a mandrel taken along line 9—9 of FIG. 1.
Figure 10:
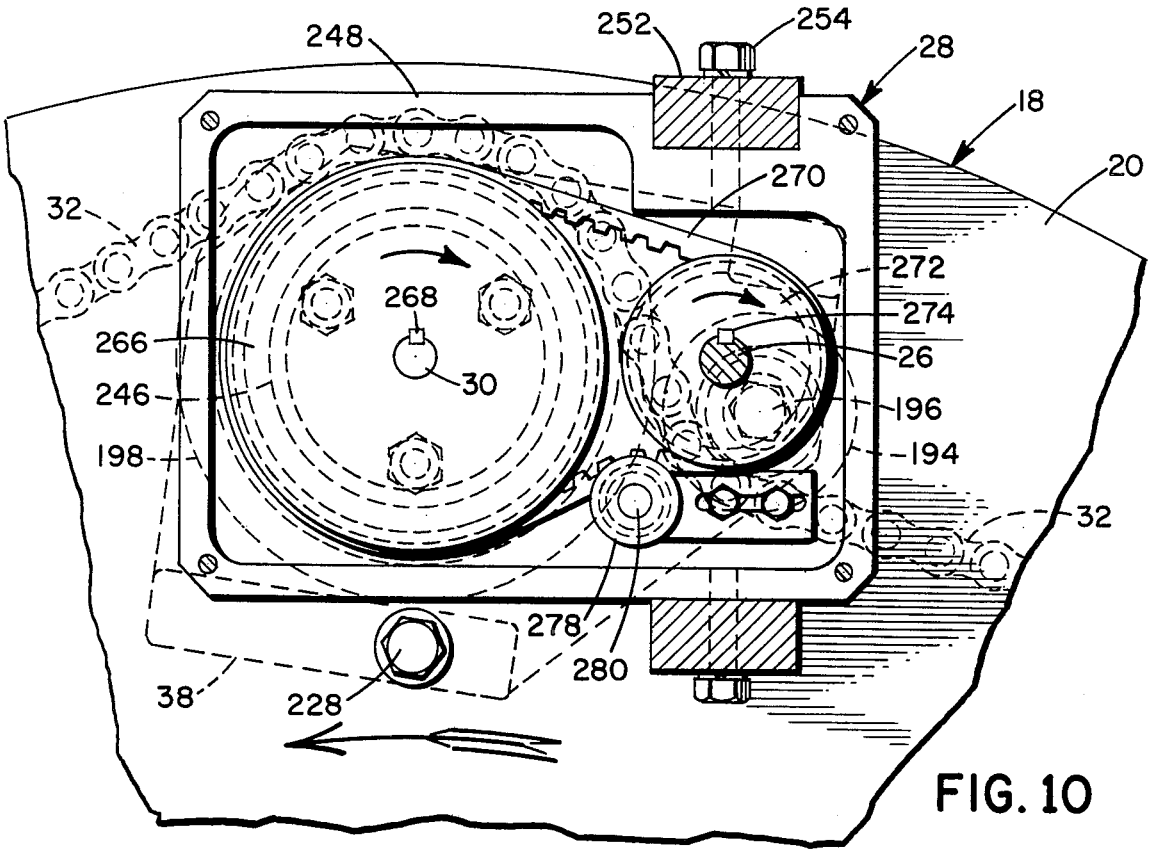
FIG. 10 is a sectional view taken along line 10—10 of FIG. 9.
Figure 11:
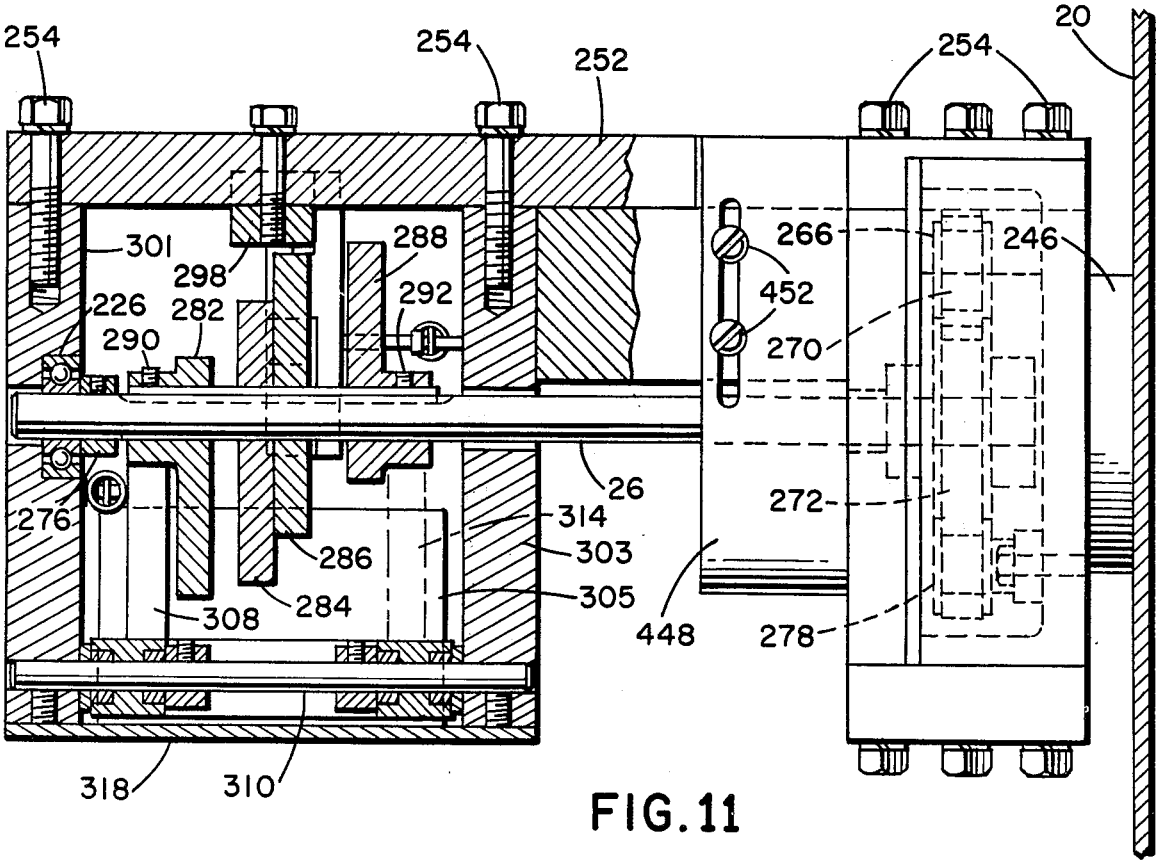
FIG. 11 is a vertical sectional and elevational view taken along line 11—11 of FIG. 9.

The mandrels 24, the planetary drive transmissions 28 and the turret pivot assemblies 38 are shown in greater detail in FIGS. 9-11. A turret pivot assembly 38 and a planetary drive transmission 28 are shown in cross section in FIG. 9. The planetary drive chain 32 engages the idler sprocket gear 194 which is freely rotatable about the stationary shaft 196 on bearings 244. The planetary drive chain 32 also engages the planetary drive gear 198 which is rigidly secured by plate 246 to the housing 248 of the planetary drive transmission 28. A front plate 250 is connected on the housing 248. The front plate 250 is rigidly secured to the mandrel 24 by mandrel support arm 252 and bolts 254. A pair of guide plates 448 and 450 are rigidly attached to the support arm 252 by bolts 452 and 454 respectively. The function of these guide plates 448 and 450 is described below in detail with reference to FIGS. 23 and 29. The planetary drive gear 198 and the plate 246 are supported on shaft 30 by a plurality of bearings 258. In addition, a plurality of bearings 256 enable the planetary drive gear 198 and the circular plate 246 to freely rotate within the turret pivot assembly 38. As a result, the planetary drive gear 198, the planetary drive transmission 28 and the mandrel 25 are rotated by the planetary drive chain 32 in a clockwise direction as the turret 18 is rotated in a counterclockwise direction by the turret drive system shown in FIG. 3. This rotation of the planetary drive gear 198 maintains the mandrel 24 in a fixed orientation with respect to the die 40.

The transmission shaft 30 is rigidly attached to the turret plate 22 by the torque arm 260 which is connected to the shaft 30 by plate 264 and key 262. The torque arm 260 is rigidly attached to the turret plate 22 by bolt 196. A sprocket gear 266 in the planetary drive transmission 28 is rigidly attached to the transmission shaft 30 by key 268. A transmission chain 270 interconnects the sprocket gear 266 and another planetary drive gear 272 which is mounted in the planetary drive transmission 28. In addition, an idler gear 278 freely rotatable on shaft 278 engages the transmission chain 270. The planetary drive gear 272 is rigidly attached to the mandrel drive shaft 26 by key 274. A plurality of bearings 276 support the mandrel drive shaft 26 and the planetary drive gear 272 on the front plate 250 of the planetary drive transmission 28. Thus, the mandrel drive shaft 26 and the planetary drive gear 272 are free to rotate with respect to the mandrel 24, the housing of the planetary drive transmission 28 and the planetary drive gear 198. As the planetary drive transmission 28 and the mandrel 24 are rotated by the planetary motion of planetary drive gear 198 about the stationary sprocket gear 202 to maintain the mandrel 24 in a fixed orientation with respect to die 40, the planetary drive gear 272 is moved by transmission chain 270 in a circular path about the stationary sprocket gear 266. This planetary motion of the planetary drive gear 272 about the stationary sprocket gear 266 causes the planetary drive gear 272 to rotate about its own axis. The planetary motion of the planetary drive gear 272 about sprocket gear 266 is similar to the planetary motion of the planetary drive gear 198 in the turret pivot assembly 38 about the stationary sprocket gear 202 shown in FIG. 4. In the preferred embodiment, the gear ratio of the planetary drive gear 272 and the sprocket gear 266 is adjusted to enable the planetary drive gear 272 to rotate twice for each rotation of the planetary drive transmission 28 about shaft 30.

The rotation of the mandrel drive shaft 26 due to the planetary motion of planetary drive gear 272 drives the corner blocks 34 and the clamping fingers 36 movable on the mandrel 24. A plurality of cams 282, 284, 286 and 288 are rigidly secured by keys 290 and 292 (keys for cams 284 and 286 not shown) to the mandrel drive shaft 26. The cam 284 operates one clamping finger 36 by engaging clamp support block 294 which is rotatably mounted on pin 296 connecting the clamp support block 294 to clamp bar 298. The cam 286 operates the other clamping finger by engaging clamp support block 300 which is rotatably mounted on pin 302 connecting the clamp support block 300 to clamp bar 298. Rollers 295 and 301 are mounted in support blocks 294 and 300 to facilitate the movement of cams 284 and 286, respectively. These clamping fingers 30 are biased in the down position by bias springs 304. In the down position, these clamping fingers 34 rest against the forming blocks 305 which are further described below. The cams 284 and 286 engage the bottoms of the clamp support blocks 294 and 300 so that the rotation of the cams 284 and 286 by the mandrel drive shaft 26 moves the clamping fingers 36 to different positions as shown in FIGS. 30–33. The different positions of the clamping fingers 36 represent different sequences in the formation of the tray. These sequences will be described in further detail below. The cam 282 operates one pair of corner blocks 34 on one side of the mandrel 24 by engaging the roller 306 of block support bar 308 which is rotatably mounted on rod 310. The other pair of corner blocks 34 are operated by cam 288 which engages the roller 312 of block support bar 314 which is also rotatably mounted on rod 310. These corner blocks 34 are biased in the down position by bias springs 316. The cams 282 and 288 engage the rollers 306 and 312 of the block supports 294 and 300 so that the rotation of the cams 282 and 288 by the mandrel drive shaft 26 moves the corner blocks 34 to different positions also shown in FIGS. 30–33. Again, these sequences will be described in further detail below.

Figure 23:
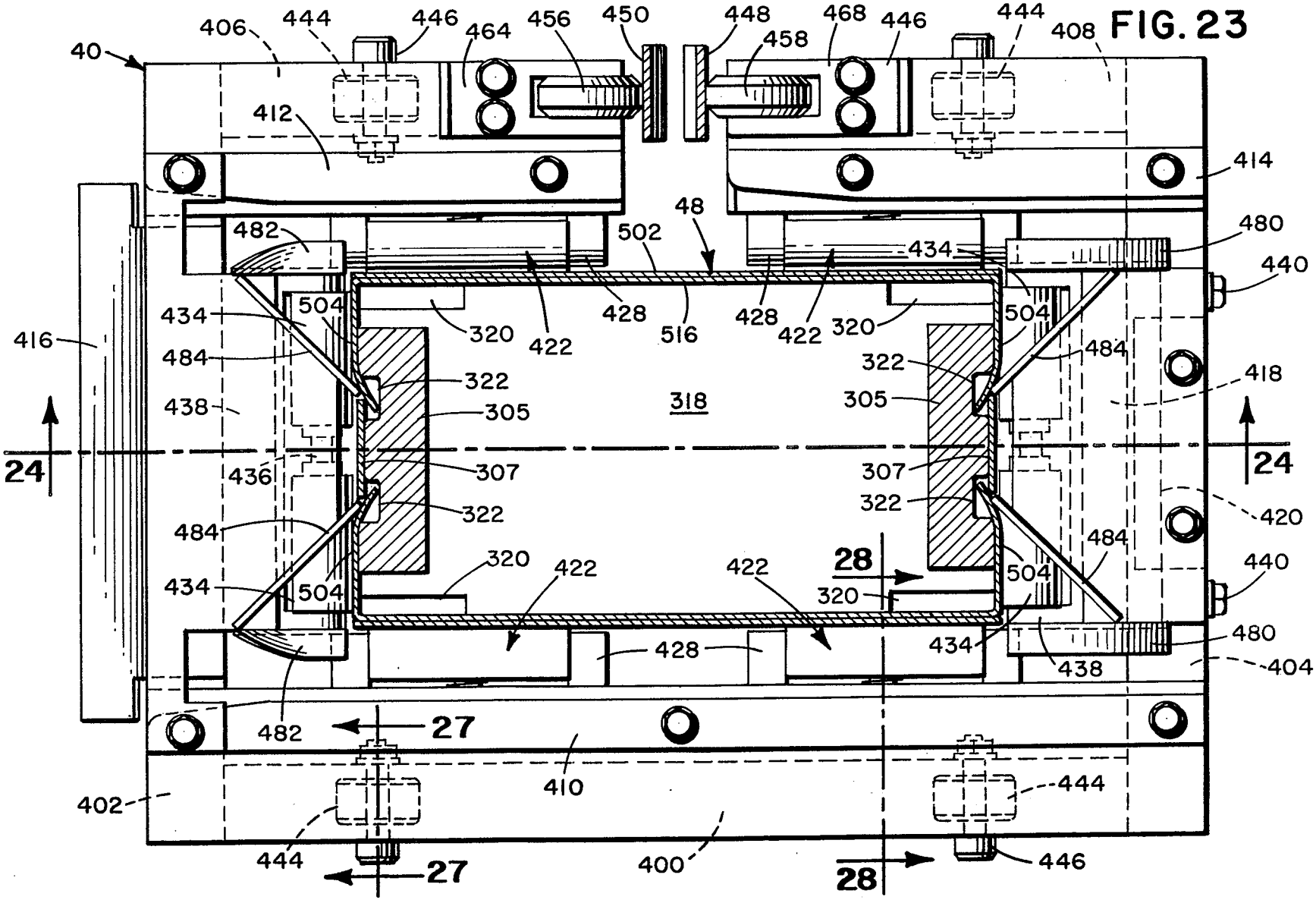
FIG. 23 is a top plan view of the die and the cooperating parts of the mandrel also showing a part of the tray in cross section.

The mandrel 24 of the present invention has a base plate 318 shown in FIGS. 9 and 23 which engages the tray blank as the mandrel 24 enters the die 40. The base plate 318 has four corner notches 320 which cooperate with the tray stripping fingers 100 shown in FIG. 1 for removing the completed tray from the mandrel without interfering with the path of movement of the mandrel 24. This operation is described in further detail below with reference to FIG. 34. In addition, the base plate 318 and the forming blocks 305 have slots 322 which latch the corner tabs 504 as the mandrel 24 passes through the die 40. A latching plate 307 covers a portion of the slots 322 in forming block 305. The latching of the corner tabs 504 in slots 522 is described below in greater detail with reference to FIG. 23.

Figure 15:
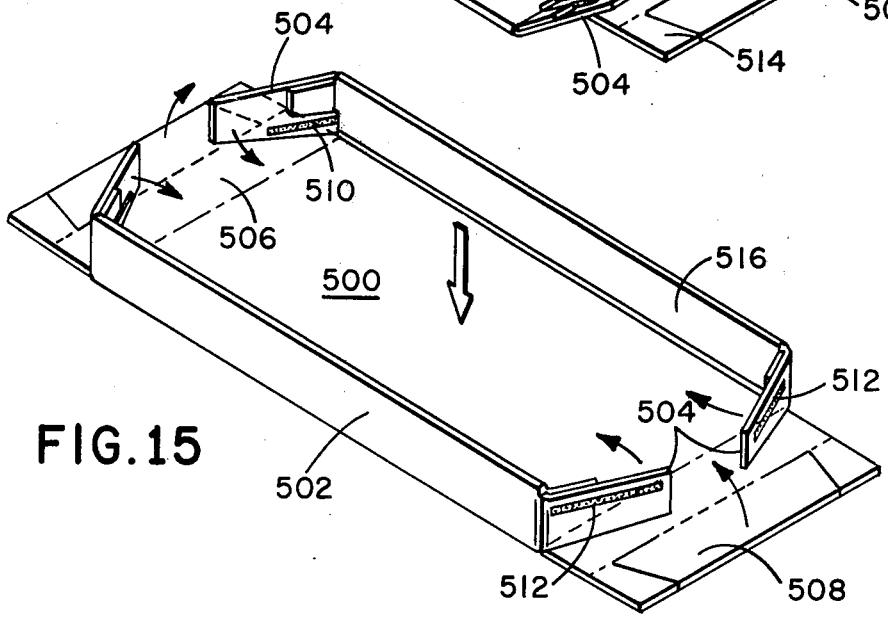
Figure 31:
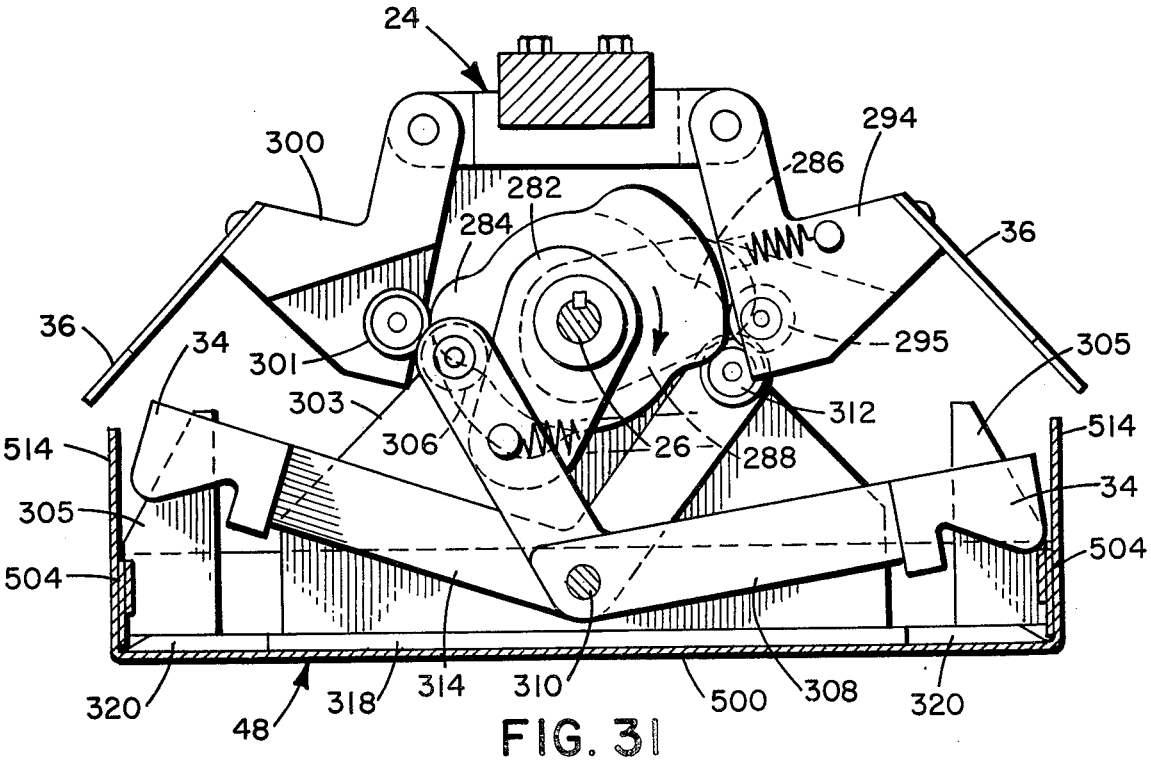
Figure 32:
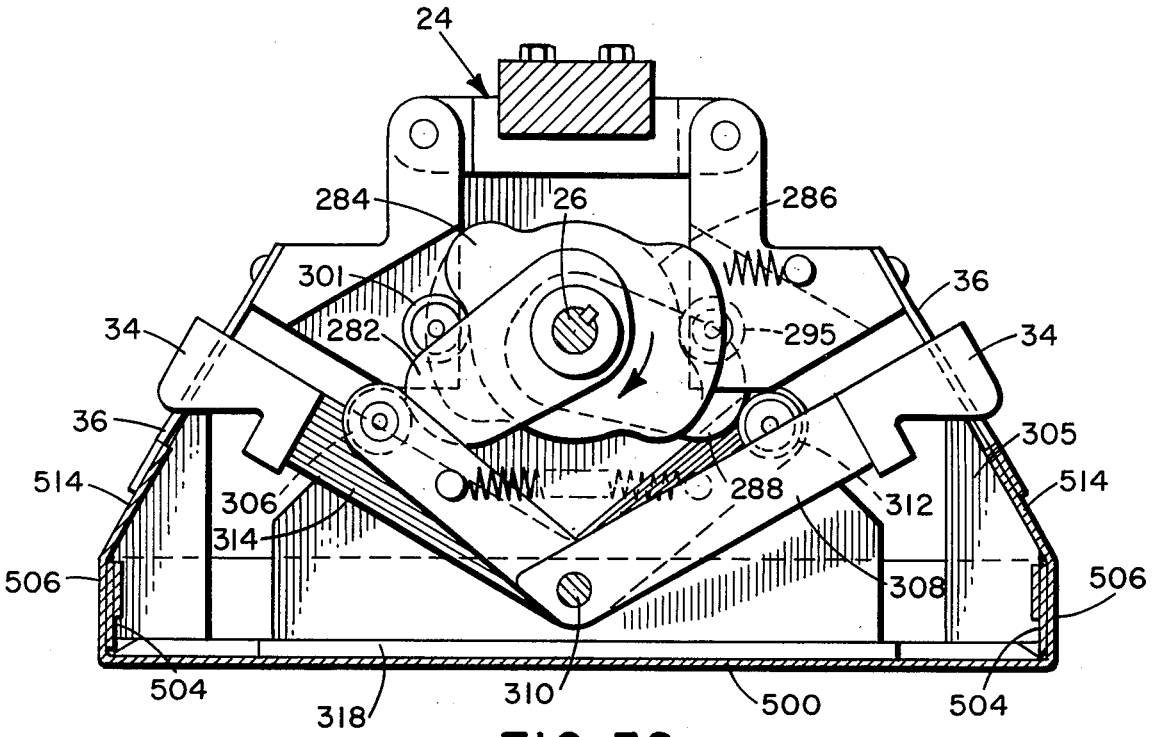
Figure 33:
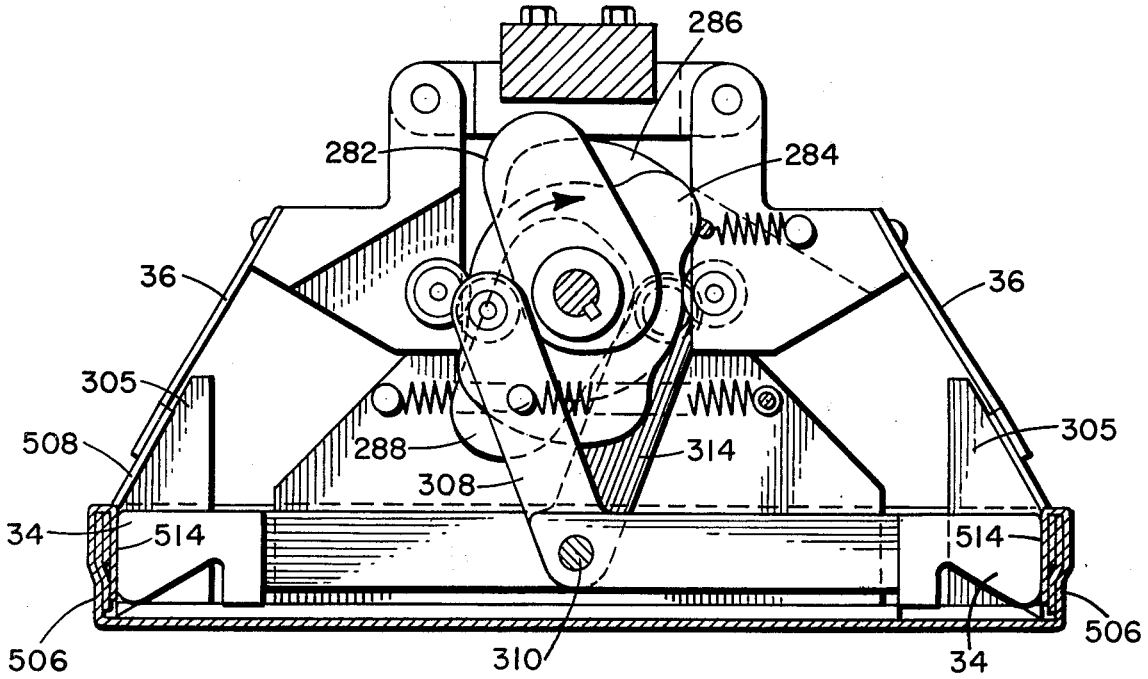

The operation of the mandrels 24 of the present invention is as follows. A plurality of mandrels 24 are moved in a circular path by turret 18. As the mandrels 24 are moved by the turret 18 a planetary drive chain 32 and planetary drive gear 198 maintain the mandrels 24 and the planetary drive transmissions 28 in a fixed orientation with respect to the die 40 of the rotary tray former of the present invention. The planetary motion of planetary drive gear 198 causes the mandrel 24 and the planetary drive transmission to rotate in a clockwise direction about shaft 30. This rotation of the planetary drive transmission 28 enables another planetary drive gear 272 in the planetary drive transmission 28 to move in a planetary path with respect to a sprocket gear 266 located in the planetary drive transmission 28. This planetary motion causes the planetary drive gear 272 to rotate the mandrel drive shaft 26 in a clockwise direction which in turn rotates a plurality of cams 282, 284, 286 and 288 located in the mandrel 24. These cams 282, 284, 286 and 288 actuate the clamping fingers 36 and the corner blocks 34. The clamping fingers 36 and the corner blocks 34 are in the position shown in FIG. 30 as the mandrel 24 is about to engage the tray blank 48. In the preferred embodiment, this corresponds to approximately the nine o'clock position of the turret 18 shown in FIG. 1. The clamping fingers 36 and the corner blocks 34 essentially remain in this position as the mandrel passes through the die 40. As described below in further detail, the side walls 502, end walls 506 and corner tabs 504 are formed by the interaction of the mandrel 24 and the die 40. FIGS. 14 and 15 show the formation of these portions of the tray blank 48. After the mandrel 24 passes through the die 40, the clamping fingers 36 and corner blocks 34 are raised by the cams 282, 284, 286 and 288 as shown in FIG. 31. Shortly thereafter, the clamping fingers 36 clamp the end flaps 508 of the tray blank 48 against the forming block 305 as shown in FIG. 32. Subsequently, the corner blocks 34 engage and form the corner hinges 514 as shown in FIG. 33. The corner blocks 34 press the corner hinges 514 against the adhesive strips 510 and 512 as shown in FIGS. 15 and 16. As the mandrel 24 passes the six o'clock position of the turret 18, the clamping fingers 36 and the corner blocks 34 are raised again in a manner similar to FIG. 31 to permit the tray stripping fingers 100 to remove the completed tray from the mandrel 24 and the tray 102 exits on the product conveyor 104.

Figure 34:
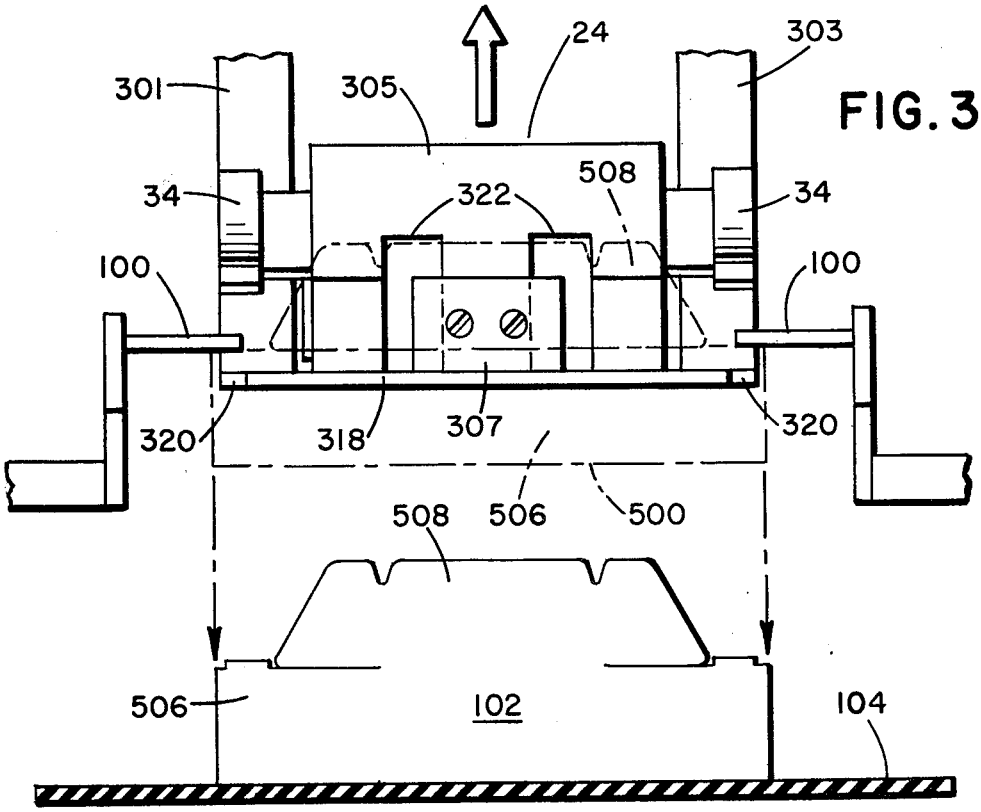
FIG. 34 is a vertical elevation of the tray removal fingers taken along line 34—34 of FIG. 1.

The orientation of the mandrel 24 remains fixed with respect to the die as the mandrel continues to move in a circular path past the tray stripping fingers 100 located at approximately the five o'clock position of the turret 18. As shown in FIG. 34, this fixed orientation of the mandrel enables the tray stripping fingers 100 to remove the completed tray 102 from the mandrel 24 without interfering with the continuous movement of the mandrel 24 in a circular path. In particular, four tray stripping fingers 100 are positioned to pass under the raised corner blocks 34 and engage the top edge of the four corners of the completed tray 102. Although the tray stripping fingers 100 project beyond the edges of the mandrel 24, these tray stripping fingers 100 do not obstruct the movement of the mandrel 24 because they pass through the four corner notches 320 of the mandrel base plate 318. Thus, the combination of the fixed orientation of the mandrel 24 and the notches 320 in the mandrel base plate 318 permits the tray stripping fingers 100 to remove the completed tray 102 from the mandrel 24 while the mandrel 24 continues to move in a circular path at a constant angular velocity.

Figures 24, 27, 28:
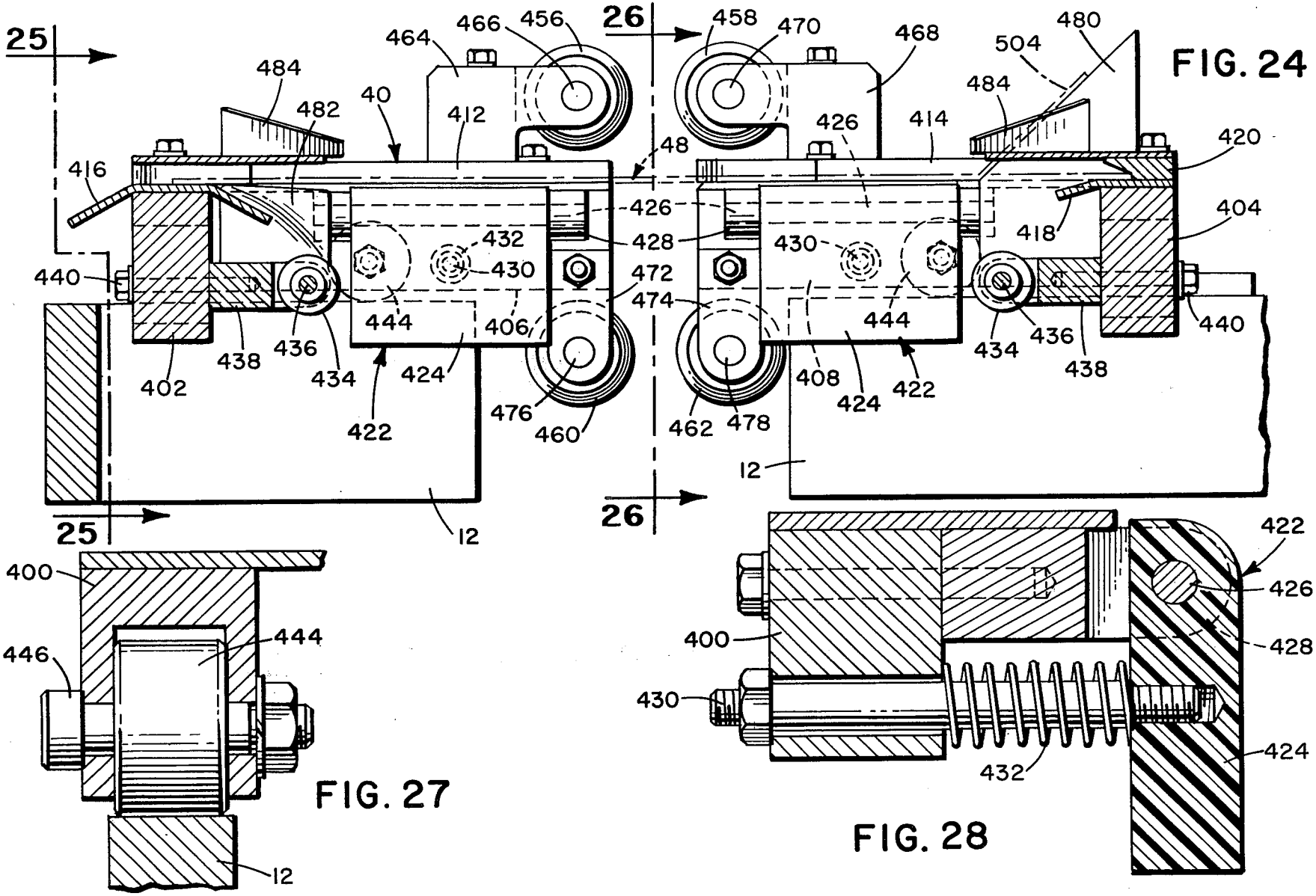
FIG. 24 is a longitudinal section of the die taken along line 24—24 of FIG. 23 with the mandrel and tray removed for the sake of clarity.
FIG. 27 is a sectional view through one side frame member of die along line 27—27 of FIG. 23 showing the die support wheels.
FIG. 28 is a sectional view through one of the side guide members of the die along line 28—28 of FIG. 23.
Figure 25:
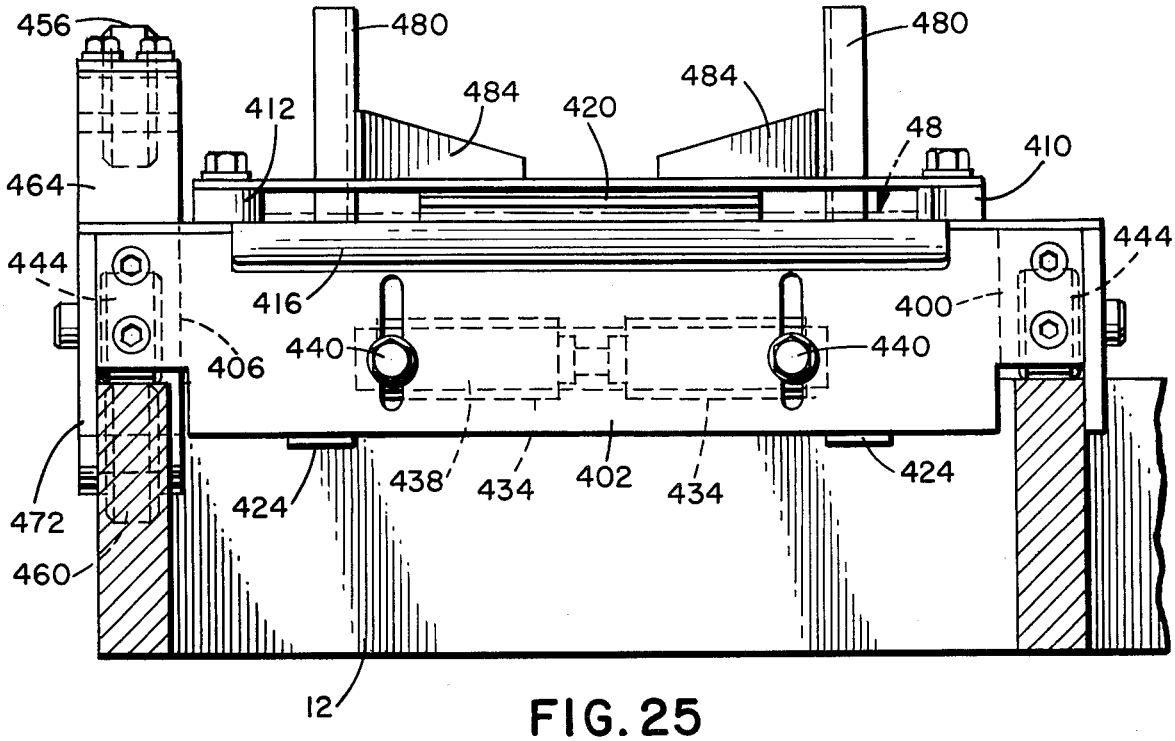
FIG. 25 is an end elevational view of the die taken along line 25—25 of FIG. 24.
Figure 26:
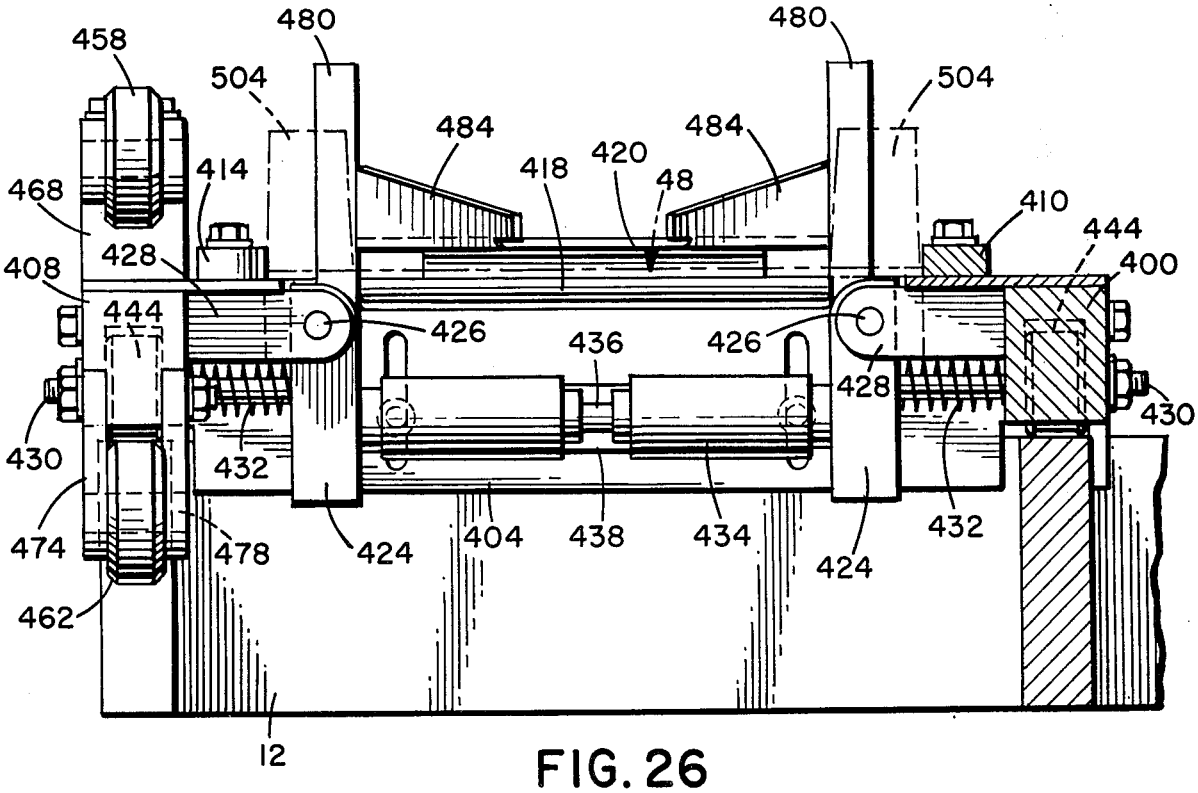
FIG. 26 is a vertical transverse section through the die taken along line 26—26 of FIG. 24.

The details of the die 40 are shown in FIGS. 23–28. The die 40 includes a side support bar 400, a front side support bar 406 and a rear side support bar 408, a front end support bar 402 and a rear end support bar 404. Side guideplates 410, 412 and 414 are mounted on support bars 400, 406 and 408 respectively. These side guideplates 410, 412, 414 guide the tray blank 48 into position on the die 40. A front lid retainer 416 is attached to front end support bar 402 and a rear lid retainer 418 is attached to rear end support bar 404. These retainers 416 and 418 guide the tray blank 48 onto the die 40 from conveyor belts 84 and 86. In addition, a back stop 420 is attached to support bar 404 for properly positioning the tray blank 48 on the die 40. Four side wall formers 422 are attached to the side support bars 406, 408 and 410. A cross-sectional view of one of these side wall formers 422 is shown in FIG. 26. Referring now to FIG. 26, a guideplate 424 is pivotally mounted on a shaft 426 supported by bar 428 which is rigidly secured to the side support bar 400. The guideplate 424 is biased by spring 432 as shown in FIG. 26. The spring 432 is supported by bolt 430 which is rigidly attached to the guideplate 424 and freely supported by side support bar 400. The pivoting of the guideplate 424 compresses the spring 432 and forces the bolt 430 to extend through the side support bar 400. The spring 432 returns the guide member 424 to its initial position after the mandrel 24 passes through the die 40. The other side wall formers 422 on side support bars 406 and 408 are similar. These side wall formers 422 interact with the base plate 318 of the mandrel 24 to form the side walls 502 of the tray blank.

At the same time the side walls 502 of the tray blank 48 are being formed by the side wall formers 422 as described above, the corner tabs 504 are being formed. As the tray blank 48 is positioned on the die 40 by the feeding mechanism as shown in FIGS. 6A and B, the corner tabs 504 on the end of the tray blank 48 which first enters the die 40 are partially folded by ramps 480. These ramps 480 which are mounted on the rear end suppot bar 404 are directly in the path of the corner tabs 504 as the tray blank 48 is fed on the die 40. Thus, the ramps 480 cooperate with the feeding mechanism to partially fold one pair of corner tabs 504 as shown in FIG. 24. The other pair of corner tabs 504 are partially folded by tab deflectors 482 which are positioned immediately underneath these corner tabs 504 when the tray blank 48 is positioned on the die. The tab deflectors 482 partially fold this other pair of corner tabs 504 immediately upon engagement of the mandrel 24 with the tray blank 48. An isometric view of the tray blank 48 in FIG. 14 shows these corner tabs 504 in their partially folded position. When the side walls 502 of the tray blank 48 are formed by the side wall formers 422 described above, the partially folded corner tabs 504 which are connected to the side walls 502 are folded toward the inside of the tray blank 48 as shown in FIG. 15. A deflector bar 484 is mounted on each of the end support bars 402 and 404 to further fold the corner tabs 504. These deflector bars 484 guide the corner tabs 504 into slots 322 in the forming block 305 and the mandrel base plate 318 of the mandrel 24. As shown in FIG. 23, these deflector bars 484 partially extend into the slots 322 in the mandrel 24. A forming block plate 307 latches these corner tabs 504 in the slots 322. The corner tabs 504 remain in this latched position in slots 322 until the completed tray is removed from the mandrel 24 by the tray stripping fingers 100 described above with reference to FIG. 34.

The end support bars 402 and 404 have rollers 434 mounted thereon for folding the end walls 506 of the tray blank 48 as the mandrel 24 passes through the die 40. As shown in FIG. 24, these rollers 434 are mounted on a shaft 436 which is rigidly secured to the end support bars 402 and 404 by arms 438 and bolts 440. These rollers 434 are vertically adjustable in slots 442 as shown in FIG. 25. In this manner, the rollers 434 can be adjusted for different tray blanks 48. In the preferred embodiment as shown in FIGS. 23–26, the rollers 434 are positioned lower than the side wall formers 422 so that the side walls 502 are formed before the end walls 506. This sequence permits the rotary tray former of the present invention to form the corner tabs 504 as described above. The interaction of the mandrel 24 and the die 40 forms the tray with the exception of the corner hinges 514 which are formed entirely by the clamping fingers 36 and the corner blocks 34 as previously described. The completed tray is shown in FIG. 16 with the side walls and end walls secured in their upright positions thereby forming an effective receptacle which functions in the conventional manner.

Figure 22:
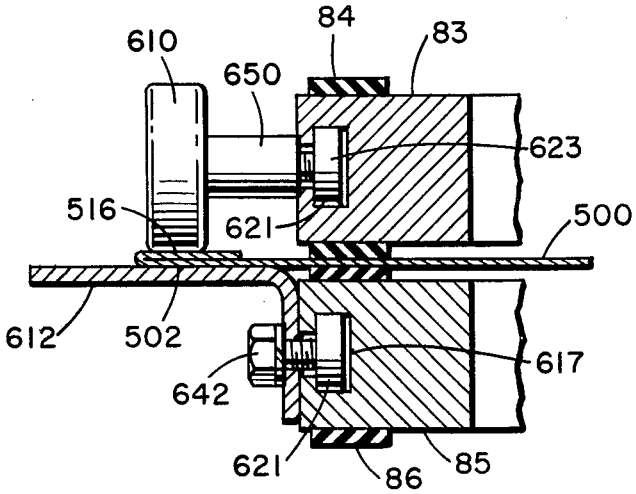
FIGS. 18–22 are sectional views similar to FIG. 16 of the hem forming elements associated with the feeding mechanism of FIGS. 6A and B.
Figure 17:
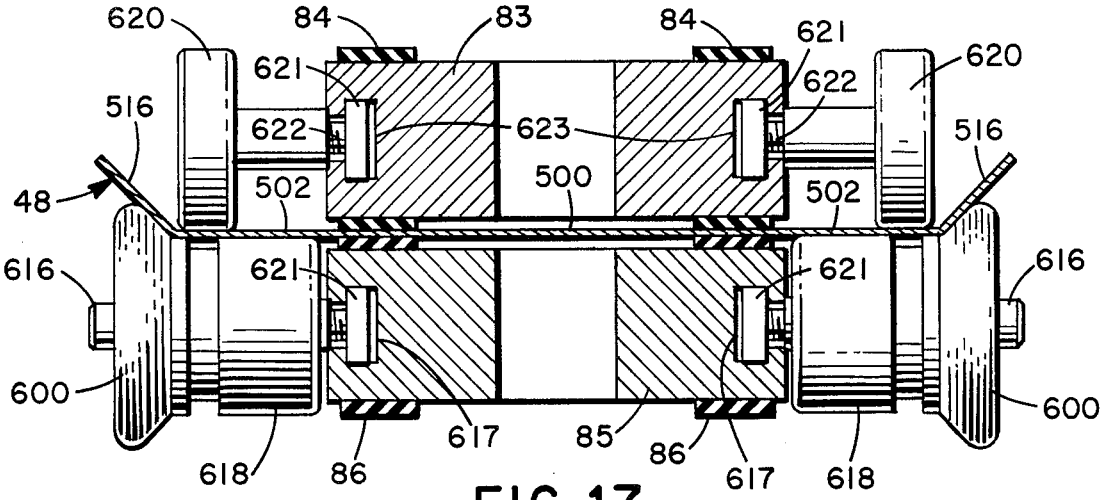
FIG. 17 is a vertical sectional view of the hem forming elements associated with the feeding mechanism taken along line 16—16 of FIGS. 6A and B.

As illustrated in FIGS. 22–24, the die 40 is movably mounted on the horizontal rail 12. The die 40 has four wheels 444 which support the die 40 on the rails 12. As shown in section in FIG. 27, these wheels 444 are rotatably mounted by bolts 446 on the side support bars 400, 406, and 408. The side support bars 400, 406 and 408 overlap the horizontal rail 12 as shown in FIG. 24 and thereby hold the die 40 on the horizontal rail 12 during the movement of the die 40.

The die 40 shown in FIG. 1 has a pair of vertically extending guideplates 44 which engage a wheel (not shown) mounted on the rotating mandrels 24. As previously described, the guideplates 44 engage the wheel on the mandrel as the mandrel 24 passes through the die 40. Since the die 40 is movable on the horizontal rail 12, the die 40 tracks the circular movement of the mandrel 24 by moving radially of the circular path on rail 12. Another embodiment of this interaction between the mandrel 24 and the die 40 is shown in FIGS. 23–29. In this preferred embodiment, guideplates 448 and 450 are mounted on the mandrel support arm 252 as shown in FIGS. 9 and 11. These guideplates 448 and 450 engage guide wheels 456, 458, 460 and 462 mounted on the die 40. Guide wheels 456 and 458 are mounted to the side support bars 406 and 408 by angle brackets 464 and 468 which support shafts 466 and 470 upon which the guide wheels 456 and 458 freely rotate. The guide wheels 460 and 462 are mounted on the side support bars 406 and 408 by brackets 472 and 474 which support shafts 476 and 478 upon which the guide wheels 460 and 462 freely rotate. As shown in FIG. 27, when the mandrel 24 engages the die 40, the guideplates 448 and 450 contact the guide wheels 456 and 458. Since the mandrel 24 remains in a fixed orientation with respect to the die, the guideplates 448 and 450 pass through the guide wheels 456, 458, 460 and 462 in a plane normal to the longitudinal plane of the die 40. In addition, as the mandrel 24 continues to move in a circular path through the die 40, the die first moves radially of the circular path in a direction away from the center of the turret 18. The maximum outward movement of the die 40 is achieved when the mandrel 24 is intermediate the upper guide wheels 456–458 and the lower guide wheels 460–462. As the mandrel 24 continues to pass through the die 40, the die 40 returns to its initial position. Thus, the die 40 tracks the circular movement of the mandrel 24 while the mandrel 24 passes through the die 40. The tracking movement of the die 40 combined with the fixed orientation of the mandrel 24 with respect to the die 40 enables the mandrel 24 to make a straight line pass through the die 40. As a result of this straight line movement between the mandrel 24 and the die 40, the forming elements on the die including the side wall formers 422, the corner tab forming elements and the end wall rollers 434 can be linearly arranged along the path of movement of the mandrel 24.

Although the operation of the different parts of the apparatus of the present invention is set forth in the above description, it is useful for a full understanding of this invention to examine the composite operation. The tray blanks 48 are stacked on support arms 46 which oscillate to prevent the tray blanks from sticking together. A feeding mechanism for feeding the tray blanks 48 to die 40 includes vacuum cups 68 which rock back and forth into timed engagement with the tray blanks 48 for separating a tray blank 48 from the stack and a feed wheel 80 for directing the tray blank onto feed conveyors 84 and 86 which position the tray blank 48 on die 40. Adhesive applicators 96 associated with the feeding mechanism apply adhesive to selected portions of the tray blank 48. In addition, a hem forming mechanism including plows 600–610 is associated with the feeding mechanism for forming a hem on the tray blank before it reaches the die 40. As the tray blank 48 enters the die 40, the corner tabs 504 on the leading edge of the tray blank 48 are partially folded by ramps 480 mounted on the die 40. Tab deflectors 482 positioned underneath other corner tabs 504 of the tray blank partially fold these other corner tabs 504 upon engagement of the tray blank by mandrel 24 moving in a circular path. The die 40 has pivotally mounted side wall formers 422 for forming the side walls 502 of the tray blank as the mandrel 24 passes through the die 40. Simultaneously with the forming of the side walls 502, the corner tabs 504 are further folded by deflector bars 484 which guide the corner tabs into slots 322 on the forming block 305 and base plate 318 of the mandrel 24. A latching plate 307 latches these corner tabs on the mandrel 24 until the completed tray is removed from the mandrel. As the mandrel 24 continues through the die 40, rollers 434 on the die 40 fold the end walls 506 of the tray blank 48. The above interaction of the mandrel 24 and the die 40 is greatly improved by the present invention by maintaining the mandrel 24 in a fixed orientation with respect to the die 40 while the mandrel 24 passes through the die 40. In addition, the die 40 is movably mounted on horizontal rail 12 to track the radial movement of the mandrel 24. As a result, the relative movement of the mandrel 24 with respect to the die 40 forms a straight line. Thus, the arcuate forming path of prior rotary tray formers is eliminated. After the mandrel moves through the die 40, clamping fingers 36 and corner blocks 34 movable on the mandrel 24 engage the end flaps 508 and form the corner hinges 514. As the mandrel 24 continues to rotate, the clamping fingers 36 and the corner blocks 34 disengage the end flaps 508 and corner hinges 514 of the completed tray. Tray stripping fingers 100 positioned adjacent the circular path of the mandrel remove the tray from the mandrel 24. Since the mandrel 24 is maintained in the same fixed orientation, the tray stripping fingers 100 can be positioned to remove the trays without interfering with the continuous circular movement of the mandrel 24. The completed tray is then transported by a product conveyor 104.

Although illustrative embodiments of the invention have been described in detail with reference to the accompanying drawings, it is to be understood that the invention is not limited to those precise embodiments and that various changes and modifications may be effected therein by one skilled in the art without departing from the scope or spirit of the invention. For example, it is to be understood that the invention is not limited for use with the receptacle blank shown in FIG. 12. For example, various modifications and adjustments can be made in the apparatus including the forming elements of the die 40 and the mandrel 24 to accommodate many different types of tray blanks. In addition, although the preferred embodiment shows a die 40 positioned in a horizontal plane and a mandrel 24 which has a fixed orientation with respect to this horizontal plane, it is within the scope of this invention to position the die 40 in different planes and modify the mandrel 24 accordingly to maintain a fixed orientation with respect to the plane of the die 40. For example, the die 40 could be positioned in a vertical plane and the mandrel 24 could be adapted to maintain a fixed orientation with respect to this vertical plane. Furthermore, the movable clamping fingers 36 and corner blocks 34 of the mandrel 24 may be modified to perform different functions. All such additions and modifications of the aparatus of the present invention are deemed to be within the scope and spirit of the present invention.

We claim:

1. An apparatus for folding a receptacle from a flat receptacle blank which includes side and end walls connected to a bottom panel, a pair of corner tabs on each end of the receptacle blank connected to the side walls, an end flap connected to each of the end walls and a pair of corner hinges connected to each end flap on perforated connected lines, said apparatus comprising:

a die for supporting the receptacle blank;

feeding means for feeding the receptacle blank on said die;

hem forming means associated with said feeding means for forming a hem on at least a portion of the receptacle blank before the receptacle blank reaches said die;

corner tab folding means on said die for folding one pair of corner tabs while the receptacle blank is fed on said forming die by said feeding means;

a mandrel for engaging the receptacle blank supported on said die;

mandrel moving means for moving said mandrel in a circular path to engage the receptacle blank and pass through said die to fold the other pair of corner tabs, the side walls and the end walls;

orientating means associated with said mandrel moving means for constantly maintaining said mandrel in a fixed orientation parallel to said die while said mandrel passes through said die;

die moving means cooperative with said mandrel for moving said die radially of the circular path to track said mandrel while said mandrel passes through said die to thereby achieve linear motion between said mandrel and said die;

corner tab latching means on said mandrel for latching the corner tabs after the side walls are folded by the passing of said mandrel through said die;

guide means on said die for guiding the corner tabs into said corner tab latching means on said mandrel as the side walls are folded;

corner hinge forming means movable on said mandrel for forming the corner hinges of the receptacle;

driving means actuated by said orientating means for driving said corner hinge forming means during engagement of said mandrel with the receptacle blank; and receptacle removing means adjacent the circular path of said mandrel for removing the receptacle from said mandrel without interfering with the movement of said mandrel in the circular path.

2. In apparatus for forming a receptacle from a flat receptacle blank, a rotary receptacle former comprising:

a die for supporting the receptacle blank;

a mandrel for engaging the receptacle blank supported by said die;

mandrel moving means for moving said mandrel in a circular path to engage the receptacle blank and pass through said die to form at least a portion of the receptacle;

orientating means associated with said mandrel moving means for constantly maintaining said mandrel in a fixed orientation parallel to said die while said mandrel passes through said die; and die moving means cooperative with said mandrel for moving said die radially of the circular path to track said mandrel while said mandrel passes through said die to thereby achieve linear motion between said mandrel and said die.

3. In apparatus according to claim 2, said orientating means comprising:

a stationary gear mounted at the center of the circular path;

a planetary gear rotatably mounted on said mandrel moving means adjacent said mandrel, said planetary gear being rigidly connected to said mandrel; and planetary drive means connecting said stationary gear and said planetary gear to rotate said planetary gear and maintain said mandrel in a fixed orientation with respect to said die.

4. In apparatus according to claim 3, said rotary receptacle former comprising a plurality of said mandrels moving in a circular path, each of said mandrels being associated with a planetary gear connected to said stationary gear by said planetary drive means to rotate said planetary gear and maintain each of said mandrels in a fixed orientation with respect to said die.

5. In apparatus according to claim 2, said rotary receptacle former comprising a plurality of said mandrels moving in a circular path, said orientating means maintaining each of said mandrels in a fixed orientation with respect to said die.

6. In apparatus according to claim 2, wherein said rotary receptacle former further comprises die support means for supporting said die and said die comprises movable support means for moving said die on said die support means, said die moving means further comprising:

guide rollers mounted on said die; and guide plates mounted on said mandrel for engaging said guide rollers on said die as said mandrel passes through said die to move said die on said die support means.

7. In apparatus according to claim 2, wherein said rotary receptacle former further comprises die support means for supporting said die and said die comprises movable support means for moving said die on said die support means, said die moving means further comprising:

guide plates mounted on said die; and a guide roller mounted on said mandrel for engaging said guide plates on said die as said mandrel passes through said die to move said die on said die support means.

8. In apparatus for forming a tray from a flat receptacle blank, a rotary tray former comprising:

a die supporting the receptacle blank;

a mandrel for engaging the receptacle blank supported by said die;

mandrel moving means for moving said mandrel in a circular path to engage the receptacle blank and pass through said die to form at least a portion of the receptacle;

pivoting means associated with said mandrel moving means for pivoting said mandrel relative to said mandrel moving means:

forming means movable on said mandrel for forming another portion of the receptacle; and driving means on said mandrel actuated solely in response to said pivoting means for driving said forming means during engagement of said mandrel with the receptaccle blank.

9. In apparatus according to claim 8, said rotary receptacle former comprising a plurality of said mandrels moving in a circular path.

10. In apparatus according to claim 8, said mandrel moving means comprising:

a turret;

mandrel support means connected to said turret for supporting said mandrel, said mandrel being pivotally mounted on said mandrel support means; and roating means connected to said turret for rotating said turret.

11. In apparatus according to claim 10, said driving means comprising:

a stationary gear mounted on said mandrel support means;

a mandrel drive shaft connected to said forming means, said mandrel drive shaft being rotatably mounted within said mandrel;

a planetary drive gear rigidly mounted on said mandrel drive shaft; and connection means for connecting said planetary drive gear and said staionary gear to rotate said planetary drive gear and said mandrel drive shaft as said mandrel pivots on said mandrel support means.

12. In apparatus according to claim 11, said driving means further comprising cam means rigidly mounted on said mandrel drive shaft for actuating said forming means on said mandrel.

13. In apparatus according to claim 11, said pivoting means being connected to said mandrel for forcing said mandrel to pivot on said mandrel support means.

14. In apparatus according to claim 8, said driving means comprising:

a mandrel drive shaft connected to said forming means, said mandrel drive shaft being rotatably mounted within said mandrel;

a planetary drive gear rigidly mounted on said mandrel drive shaft; and planetary drive means responsive to the pivoting of said mandrel on said mandrel moving means to rotate said planetary drive gear and said mandrel drive shaft.

15. In apparatus according to claim 14, said planetary drive means comprising:

a stationary gear mounted on said mandrel moving means; and connection means for connecting said stationary gear and said planetary drive gear to rotate said planetary drive gear as said mandrel pivots on said mandrel moving means.

16. In apparatus according to claim 14, said driving means further comprising cam means rigidly mounted on said mandrel drive shaft for actuating said forming means on said mandrel.

17. In apparatus for forming a receptacle from a flat receptacle blank, a rotary receptacle former comprising:

a die for supporting the receptacle blank;

a mandrel for engaging the receptacle blank supported by said die;

mandrel moving means for moving said mandrel in a circular path to engage the receptacle blank and pass through said die to form at least a portion of the receptacle;

orientating means associated with said mandrel moving means for constantly maintaining said mandrel in a fixed orientation parallel to said die during engagement of said mandrel with the receptacle blank;

forming means movable on said mandrel for forming another portion of the receptacle; and driving means responsive solely to the action of said orienting means in maintaining said mandrel in a fixed orientation for driving said forming means on said mandrel during engagement of said mandrel with the receptacle blank.

18. In apparatus according to claim 17, said rotary receptacle former comprising a plurality of mandrels moving in a circular path.

19. In apparatus according to claim 17, said mandrel moving means comprising:

a turret;

mandrel support means connected to said turret for supporting said mandrel, said mandrel being pivotally mounted on said mandrel support means; and rotating means connected to said turret for rotating said turret.

20. In apparatus according to claim 19, said driving means comprising:

a stationary gear mounted on said mandrel support means;

a mandrel drive shaft connected to said forming means, said mandrel drive shaft being rotatably mounted within said mandrel;

a planetary drive gear rigidly connected on said mandrel drive shaft; and connection means for connecting said planetary drive gear and said stationary gear to rotate said planetary gear and said mandrel drive shaft in response to the reorientation of said mandrel by said orientating means.

21. In apparatus according to claim 20, said driving means further comprising cam means rigidly mounted on said mandrel drive shaft for actuating said forming means on said mandrel.

22. In apparatus according to claim 17, said driving means comprising:

a mandrel drive shaft connected to said forming means, said mandrel drive shaft being rotatably mounted within said mandrel;

a planetary drive gear rigidly mounted on said mandrel drive shaft; and planetary drive means responsive to the reorientation of said mandrel by said orientating means to rotate said planetary drive gear and said mandrel drive shaft.

23. In apparatus according to claim 22, said planetary drive means comprising:

a stationary gear mounted on said mandrel moving means; and connection means for connecting said stationary gear and said planetary drive gear to rotate said planetary drive gear in response to the reorientation of said mandrel by said orientating means.

24. In apparatus according to claim 23, said driving means further comprising cam means rigidly mounted on said mandrel drive shaft for actuating said forming means on said mandrel.

25. In apparatus for forming a receptacle from a flat receptacle blank, a rotary receptacle former comprising:

a die for supporing the receptable blank;

a mandrel for engaging the receptacle blank supported by said die;

mandrel moving means for moving said mandrel in a circular path to engage the receptacle blank and pass through said die to form the receptacle;

stationary receptacle removing means adjacent the circular path for removing the receptacle from said mandrel; and orientating means associated with said mandrel moving means for constantly maintaining said mandrel in a fixed orientation as said mandrel moves in a circular path, said orientating means cooperating with said receptacle removing means to prevent said receptacle removing means from interfering with the movement of said mandrel in the circular path.

26. In apparatus according to claim 25, said receptacle removing means comprising stripping fingers partially extending into the plane of said mandrel for engaging a portion of the receptacle.

27. In apparatus according to claim 26, said mandrel comprising a base plate having notches along at least a portion of the edge of the base plate to permit said stripping fingers to remove the tray from said mandrel and pass through said notches as said mandrel continues to move in a circular path.

28. In apparatus according to claim 25, said rotary receptacle former further comprising forming means movable on said mandrel for forming a portion of the receptacle and drive means for driving said forming means to a predetermined position as said mandrel passes said receptacle removing means to prevent said receptacle removing means from interfering with the movement of said mandrel in the circular path.

29. An apparatus for forming a receptacle from a flat receptacle blank which includes side walls and one pair of corner tabs on each end of the receptacle blank connected to the side walls, said apparatus comprising:

a die for supporting the receptacle blank;

feeding means for feeding the receptacle blank on said die;

a mandrel for engaging the receptacle blank supported on said die;

mandrel moving means for moving said mandrel in a circular path to engage the receptacle blank and pass through said die;

corner tab folding means on said die for folding one pair of corner tabs while the receptacle blank is fed on said forming die by said feeding means and folding the other pair of corner tabs as said mandrel engages the receptacle blank and commences to move through said die;

side wall folding means on said die cooperative with said mandrel for folding the side walls as said mandrel moves through said die;

corner tab latching means on said mandrel for latching the corner tabs after the side walls are folded by said wall folding means; and guide means on said die for guiding the corner tabs into said corner tab latching means on said mandrel as the side walls are folded by said side wall folding means.

30. An apparatus for forming a receptacle from a flat blank which includes side walls and one pair of corner tabs on each end of the receptacle blank connected to the side walls, said apparatus comprising:

a die for supporting the receptacle blank;

feeding means for feeding the receptacle blank on said die;

a mandrel for engaging the receptacle blank supported on said die;

mandrel moving means for moving said mandrel in a circular path to engage the receptacle blank and pass through said die; and corner tab folding means on said die for folding one pair of corner tabs while the receptacle blank is fed on said die by said feeding means.

31. An apparatus according to claim 30 wherein said corner tab folding means comprises ramps mounted on one end of said die directly in the path of the receptacle blank while the receptacle blank is fed on said die.

32. An apparatus for forming a receptacle from a flat receptacle blank which includes side walls and one pair of corner tabs on each end of the receptacle blank connected to the side walls, said apparatus comprising:

a die for supporing the receptacle blank;

a mandrel for engaging the receptacle blank in said die;

mandrel moving means for moving said mandrel in a circular path to engage the receptacle blank and pass through said die;

folding means on said die for folding the corner tabs and the side walls as said mandrel moves through said die;

corner tab latching means on said mandrel for latching the corner tabs after the side walls are folded by said folding means; and guide means on said die for guiding the corner tabs into said corner tab latching means on said mandrel as the side walls are folded by said folding means.

33. An apparatus according to claim 32 wherein said corner tab latching means comprises slots on said mandrel partially covered by a latching plate for latching the corner tabs of the receptacle blank.

34. An apparatus according to claim 33 wherein said guide means comprises tab deflectors on said die extending above the receptacle blank and projecting into said slots on said mandrel to deflect the corner tabs into said slots as the side walls of the receptacle blank are folded by said folding means.

35. An apparatus for forming a receptacle blank which includes end walls, an end flap connected to each end wall and a pair of corner hinges connected to each end flap on perforated connection lines, said apparatus comprising:

a die for supporting the receptacle blank;

a mandrel for engaging the receptable blank in said die;

mandrel moving means for moving said mandrel in a circular path to engage the receptacle blank and pass through said die;

folding means on said die for folding the end wall as said mandrel moves through said die;

clamping means movable on said mandrel for clamping the end flaps after the end walls are folded by said folding means;

corner hinge forming means movable on said mandrel for breaking the perforated connection lines between the corner hinges and the end flaps and folding the corner hinges to form a portion of the receptacle; and driving means for driving said clamping means and said corner hinge forming means as said mandrel moves in the circular path.

* * * * *